US010538124B2

(12) United States Patent
Ito

(10) Patent No.: US 10,538,124 B2
(45) Date of Patent: Jan. 21, 2020

(54) RETRACTABLE WRITING INSTRUMENT

(71) Applicant: KABUSHIKI KAISHA PILOT CORPORATION, Tokyo (JP)

(72) Inventor: Yoshihiro Ito, Aichi (JP)

(73) Assignee: KABUSHIKI KAISHA PILOT CORPORATION, Tokyo (JP)

( * ) Notice: Subject to any disclaimer, the term of this patent is extended or adjusted under 35 U.S.C. 154(b) by 1 day.

(21) Appl. No.: 16/061,817

(22) PCT Filed: Dec. 5, 2016

(86) PCT No.: PCT/JP2016/086078
§ 371 (c)(1),
(2) Date: Jun. 13, 2018

(87) PCT Pub. No.: WO2017/104468
PCT Pub. Date: Jun. 22, 2017

(65) Prior Publication Data

US 2018/0361781 A1 Dec. 20, 2018

(30) Foreign Application Priority Data

Dec. 18, 2015 (JP) ..... 2015-246906
Jun. 20, 2016 (JP) ..... 2016-122184

(51) Int. Cl.
*B43K 24/02* (2006.01)
*B43K 24/08* (2006.01)
(Continued)

(52) U.S. Cl.
CPC ..... *B43K 24/082* (2013.01); *B43K 7/12* (2013.01); *B43K 24/084* (2013.01); *B43K 25/028* (2013.01)

(58) Field of Classification Search
CPC ..... B43K 24/084; B43K 25/028
(Continued)

(56) References Cited

U.S. PATENT DOCUMENTS 3,273,541 A 9/1966 Thurman et al.
4,025,204 A * 5/1977 Hobbs ..... B43K 24/06 401/109

(Continued)

FOREIGN PATENT DOCUMENTS

| | | |
|---|---|---|
| JP | 2003-305990 | 10/2003 |
| JP | 2006-21430 | 1/2006 |
| WO | 2011/096357 | 8/2011 |

OTHER PUBLICATIONS

International Search Report dated Feb. 14, 2017 in International (PCT) Application No. PCT/JP2016/086078.

(Continued)

*Primary Examiner* — Jennifer C Chiang
(74) *Attorney, Agent, or Firm* — Wenderoth, Lind & Ponack, L.L.P.

(57) ABSTRACT

A retractable writing instrument includes a push member including a clip and a protruding and retracting mechanism that causes a pen point to protrude from and retract into a front end of the barrel at a frontward press on the push member, without the push member rotating with respect to the instrument. The protruding and retracting mechanism includes cam teeth and cam grooves formed in an inner face of the barrel, a rotary member including protuberances engageable alternately with the cam teeth or the cam grooves, a cam member connected to the push member and includes cam projections rotating the rotary member, and engagement projections engaged with the cam grooves in the inner face of the barrel so as to be movable in the longitudinal direction; and a resilient element that biases the writing element rearward. The push member and the cam member are in detent engagement with each other.

19 Claims, 33 Drawing Sheets

(51) Int. Cl.
*B43K 7/12* (2006.01)
*B43K 25/02* (2006.01)

(58) Field of Classification Search
USPC ..... 401/109, 110
See application file for complete search history.

(56) References Cited

U.S. PATENT DOCUMENTS

| | | | | |
|---|---|---|---|---|
| 5,263,786 | A | 11/1993 | Kageyama | |
| 6,336,761 | B1 * | 1/2002 | Kudo | B43K 25/028 401/106 |
| 2012/0308290 | A1 | 12/2012 | Ito | |

OTHER PUBLICATIONS

Extended European Search Report dated Oct. 8, 2019 in European Application No. 16875451.3.

* cited by examiner

RETRACTABLE WRITING INSTRUMENT

TECHNICAL FIELD

The present invention relates to a retractable writing instrument. More specifically, the present invention relates to a retractable writing instrument including a protruding and retracting mechanism that causes a pen point of a writing element to protrude from and retract into a front end of a barrel at a frontward press on a push member including a clip.

BACKGROUND ART

With regard to conventional writing instruments of this type, for example, Patent Literature 1 discloses a detent structure for a clip-equipped push member of a writing instrument. The writing instrument includes: a barrel; a writing element that is slidable in the barrel; operative means that enables the sliding of the writing element from a rear side of the writing element; and the clip-equipped push member that operates the operative means from an outer side of a rear end of the writing instrument. In the writing instrument, detent means is applied to an outer wall of a tubular main body of the push member and an inner wall of the barrel to prevent the push member from rotating with respect to the barrel. Patent Literature 1 also discloses a configuration of detent means including a locking groove formed in an inner wall of a rear end of the barrel and a locking projection formed on an outer wall of the push member and a configuration of detent means including a locking projection formed on the inner wall of the rear end of the barrel and a locking groove formed in the outer wall of the push member.

CITATION LIST

Patent Literature

Patent Literature 1: Japanese Patent Laid-open Publication No. 2006-21430

SUMMARY OF INVENTION

Technical Problem

According to the writing instrument disclosed in Patent Literature 1, in a pen point retracting state, an amount of engagement between the locking projection (locking rib) and the locking groove in a longitudinal direction is reduced, which may cause deterioration of a detent function of the push member relative to the barrel. Also in the pen point retracting state (i.e., in an unwritable state), if force in a rotation direction is unintentionally exerted on the clip, the locking projection (locking rib) and the locking groove are disengaged from each other, so that the push member may rotate.

The present invention has been made to solve this conventional problem and provides a retractable writing instrument that reliably prevents a push member including a clip from rotating with respect to a barrel even in a pen point retracting state.

In the present invention, "front" refers a pen point side, and "rear" refers to the opposite side to the pen point side. Also in the present invention, a pen point protruding state refers a state in which a pen point protrudes outward from a front end of a barrel, and a pen point retracting state refers a state in which the pen point retracts into the barrel.

Solutions to Problem

A first aspect of the present invention provides a retractable writing instrument 1 comprising: a barrel 2; a writing element 3 that is accommodated in the barrel 2 and is movable in a longitudinal direction; a push member 9 that includes a clip 91 and is disposed on a rear end portion of the barrel 2; and a protruding and retracting mechanism that causes a pen point 31 of the writing element 3 to protrude from and retract into a front end of the barrel 2 at a frontward press on the push member 9, the protruding and retracting mechanism including: a plurality of cam teeth 61 and a plurality of cam grooves 62 that are formed on and in an inner face of the barrel 2, are arranged alternately along a circumferential direction, and extend in the longitudinal direction; a rotary member 7 that is rotatably disposed rearward of the writing element 3 and includes a plurality of protuberances 75 engageable alternately with the cam teeth 61 or the cam grooves 62; a cam member 8 that is connected to the push member 9 and includes a plurality of cam projections 83 rotating the rotary member 7, and a plurality of engagement projections 84 engaged with the cam grooves 62 in the inner face of the barrel 2 so as to be movable in the longitudinal direction; and a resilient element 10 that biases the writing element 3 rearward, wherein the push member 9 and the cam member 8 are in detent engagement with each other.

In the retractable writing instrument 1 according to the first aspect, as described above, the engagement projections 84 of the cam member 8 are always engaged with the cam grooves 62 in the inner face of the barrel 2, and the push member 9 and the cam member 8 are always in detent engagement with each other. This configuration reliably prevents the push member 9 including the clip 91 from rotating with respect to the barrel 2 even in a pen point retracting state. In the present invention, the clip 91 of the push member 9 extends outward in a radial direction from an outer face of the barrel 2 and has a function of pinching an object to be pinched, such as a pocket, in conjunction with the outer face of the barrel 2. In the present aspect, the detent engagement may be an engagement structure to prevent mutual rotation between the push member 9 and the cam member 8. Examples of the engagement structure may include: a structure in that a front-end wall of the push member 9 is engaged with a rear-end wall of the cam member 8; a structure in that an inner or outer sidewall of the push member 9 is engaged with an outer or inner sidewall of the cam member 8; and a structure in that the front-end wall of the push member 9 is engaged with the rear-end wall of the cam member 8 and the inner or outer sidewall of the push member 9 is engaged with the outer or inner sidewall of the cam member 8.

A second aspect of the present invention provides the retractable writing instrument 1 according to the first aspect, wherein the push member 9 includes a tubular portion 93 inserted into a rear-end opening of the barrel 2, the cam member 8 includes an insertion portion 82 inserted into the tubular portion 93, and an inner wall of the tubular portion 93 and an outer wall of the insertion portion 82 are in detent engagement with each other.

In the retractable writing instrument 1 according to the second aspect, the configuration described above achieves a structure to reliably prevent the mutual rotation between the push member 9 and the cam member 8.

A third aspect of the present invention provides the retractable writing instrument 1 according to the second aspect, wherein a plurality of recessed portions 93*b* extending in the longitudinal direction are formed in an inner face of the tubular portion 93, a plurality of projecting portions 85 engageable with the recessed portions 93*b* are formed on an outer face of the insertion portion 82, and the push member 9 and the cam member 8 are in detent engagement with each other by engagement of the recessed portions 93*b* with the projecting portions 85.

In the retractable writing instrument 1 according to the third aspect, the configuration described above achieves a structure to more reliably prevent the mutual rotation between the push member 9 and the cam member 8.

A fourth aspect of the present invention provides the retractable writing instrument 1 according to the third aspect, wherein an amount of play between the cam grooves 62 and the engagement projections 84 in a rotation direction is set to be larger than an amount of play between the recessed portions 93*b* and the projecting portions 85 in the rotation direction.

In the retractable writing instrument 1 according to the fourth aspect, even when a positional deviation in the rotation direction occurs at engagement of the recessed portions 93*b* in an inner face of the push member 9 with the projecting portions 85 on an outer face of the cam member 8, the cam grooves 62 in the inner face of the barrel 2 are appropriately engaged with the engagement projections 84 on the outer face of the cam member 8. The configuration described above thus reduces occurrence of sliding failure at the cam grooves 62 and the engagement projections 84.

A fifth aspect of the present invention provides the retractable writing instrument 1 according to any of the first to fourth aspects, wherein a locking wall portion 63 at which the engagement projections 84 are locked in the longitudinal direction in a pen point retracting state is formed on rear ends of the cam grooves 62, a guide groove 65 communicating with one of the cam grooves 62 and extending in the longitudinal direction is formed in the inner face of the barrel 2 and is located rearward of the cam grooves 62, a guide projection 93*a* is formed on an outer face of the tubular portion 93 in the push member 9, the guide projection 93*a* is engaged with the guide groove 65 in the pen point retracting state, and the guide projection 93*a* is engaged with one of the cam grooves 62 in a pen point protruding state.

In the retractable writing instrument 1 according to the fifth aspect, the configuration described above further prevents the rotation of the push member 9, by the engagement of the guide groove 65 with the guide projection 93*a* in the pen point retracting state. Also in the retractable writing instrument 1 according to the fifth invention, the aspect described above eliminates a necessity to form a guide groove 65 having a length corresponding to a push stroke of the push member 9 and allows a lengthwise size of the barrel 2 located rearward of the cam grooves 62 to be set shorter, which results in an increase of the degree of freedom about design of the push member 9 and barrel 2.

A sixth aspect of the present invention provides the retractable writing instrument 1 according to any of the first to fifth aspects, wherein the push member 9 includes: the clip 91; a clip base portion 92 that is formed integrally and continuously with a rear portion of the clip 91; and a tubular portion 93 that is formed integrally and continuously with the clip base portion 92, a slide hole 64 extending in the longitudinal direction is formed in a sidewall of the rear end portion of the barrel 2 and is opened rearward at a rear end of the barrel 2, a front end portion of the clip base portion 92 is inserted into the slide hole 64 in a pen point protruding state, and the front end portion of the clip base portion 92 is located rearward of the slide hole 64 in a pen point retracting state.

In the retractable writing instrument 1 according to the sixth aspect, the configuration described above allows a length of the clip base portion 92 in a lengthwise direction to be set at a satisfactory length and improves the durability of the clip 91.

A seventh aspect of the present invention provides the retractable writing instrument 1 according to the second aspect, wherein a plurality of projecting portions 93*e* extending in the longitudinal direction are formed on an inner face of the tubular portion 93, a plurality of recessed portions 88 engageable with the projecting portions 93*e* are formed in an outer face of the insertion portion 82, and the push member 9 and the cam member 8 are in detent engagement with each other by engagement of the projecting portions 93*e* with the recessed portions 88.

In the retractable writing instrument 1 according to the seventh aspect, the configuration described above achieves a structure to more reliably prevent the mutual rotation between the push member 9 and the cam member 8.

An eighth aspect of the present invention provides the retractable writing instrument 1 according to the seventh aspect, wherein an amount of play between the cam grooves 62 and the engagement projections 84 in a rotation direction is set to be larger than an amount of play between the projecting portions 93*e* and the recessed portions 88 in the rotation direction.

In the retractable writing instrument 1 according to the eighth aspect, even when a positional deviation in the rotation direction occurs at engagement of the projecting portions 93*e* on an inner face of the push member 9 with the recessed portions 88 in an outer face of the cam member 8, the cam grooves 62 in the inner face of the barrel 2 are appropriately engaged with the engagement projections 84 on the outer face of the cam member 8. The configuration described above thus reduces occurrence of sliding failure at the cam grooves 62 and the engagement projections 84.

A ninth aspect of the present invention provides the retractable writing instrument 1 according to the seventh or eighth aspect, wherein a locking wall portion 63 at which the engagement projections 84 are locked in the longitudinal direction in a pen point retracting state is formed on rear ends of the cam grooves 62, a guide groove 65 communicating with one of the cam grooves 62 and extending in the longitudinal direction is formed in the inner face of the barrel 2 and is located rearward of the cam grooves 62, a guide projection 93*a* is formed on an outer face of the tubular portion 93 of the push member 9, the guide projection 93*a* is engaged with the guide groove 65 in the pen point retracting state, and the guide projection 93*a* is engaged with one of the cam grooves 62 in a pen point protruding state.

In the retractable writing instrument 1 according to the ninth aspect, the configuration described above further prevents the rotation of the push member 9, by the engagement of the guide groove 65 with the guide projection 93*a* in the pen point retracting state. Also in the retractable writing instrument 1 according to the ninth aspect, the configuration described above eliminates a necessity to form a guide groove 65 having a length corresponding to a push stroke of the push member 9 and allows a lengthwise size of the barrel 2 located rearward of the cam grooves 62 to be set shorter, which results in an increase of the degree of freedom about design of the push member 9 and barrel 2.

A tenth aspect of the present invention provides the retractable writing instrument 1 according to any of the seventh to ninth aspects, wherein the push member 9 includes: the clip 91; a clip base portion 92 that is formed integrally and continuously with a rear portion of the clip 91; and the tubular portion 93 that is formed integrally and continuously with the clip base portion 92, a slide hole 64 extending in the longitudinal direction is formed in a sidewall of the rear end portion of the barrel 2 and is opened rearward at a rear end of the barrel 2, a front end portion of the clip base portion 92 is inserted into the slide hole 64 in a pen point protruding state, and the front end portion of the clip base portion 92 is located rearward of the slide hole 64 in a pen point retracting state.

In the retractable writing instrument 1 according to the tenth aspect, the configuration described above allows a length of the clip base portion 92 in a lengthwise direction to be set at a satisfactory length and improves the durability of the clip.

An eleventh aspect of the present invention provides the retractable writing instrument 1 according to the first aspect, wherein the cam member 8 includes a tubular portion 89, the push member 9 includes an insertion portion 95 inserted into the tubular portion 89 of the cam member 8, and an inner wall of the tubular portion 89 and an outer wall of the insertion portion 95 are in detent engagement with each other.

In the retractable writing instrument 1 according to the eleventh aspect, the configuration described above achieves a structure to reliably prevent the mutual rotation between the push member 9 and the cam member 8.

A twelfth aspect of the present invention provides the retractable writing instrument 1 according to the eleventh aspect, wherein a plurality of recessed portions 89*a* extending in the longitudinal direction are formed in an inner face of the tubular portion 89, a plurality of projecting portions 95*a* engageable with the recessed portions 89*a* are formed on an outer face of the insertion portion 95, and the push member 9 and the cam member 8 are in detent engagement with each other by engagement of the recessed portions 89*a* with the projecting portions 95*a*.

In the retractable writing instrument 1 according to the twelfth aspect, the configuration described above achieves a structure to more reliably prevent the mutual rotation between the push member 9 and the cam member 8.

A thirteenth aspect of the present invention provides the retractable writing instrument according to the twelfth aspect, wherein an amount of play between the cam grooves 62 and the engagement projections 84 in a rotation direction is set to be larger than an amount of play between the recessed portions 89*a* and the projecting portions 95*a* in the rotation direction.

In the retractable writing instrument 1 according to the thirteenth aspect, even when a positional deviation in the rotation direction occurs at engagement of the projecting portions 95*a* on an outer face of the push member 9 with the recessed portions 89*a* in an inner face of the cam member 8, the cam grooves 62 in the inner face of the barrel 2 are appropriately engaged with the engagement projections 84 on the outer face of the cam member 8. The configuration described above thus reduces occurrence of sliding failure at the cam grooves 62 and the engagement projections 84.

A fourteenth aspect of the present invention provides the retractable writing instrument 1 according to any of the eleventh to thirteenth aspects, wherein the push member 9 includes: the clip 91; a clip base portion 92 that is formed integrally and continuously with a rear portion of the clip 91; and the insertion portion 95 that is formed integrally and continuously with the clip base portion 92, a slide hole 64 extending in the longitudinal direction is formed in a sidewall of the rear end portion of the barrel 2 and is opened rearward at a rear end of the barrel 2, a front end portion of the clip base portion 92 is inserted into the slide hole 64 in a pen point protruding state, and the front end portion of the clip base portion 92 is located rearward of the slide hole 64 in a pen point retracting state.

In the retractable writing instrument 1 according to the fourteenth aspect, the configuration described above allows a length of the clip base portion 92 in a lengthwise direction to be set at a satisfactory length and improves the durability of the clip.

A fifteenth aspect of the present invention provides the retractable writing instrument 1 according to the eleventh aspect, wherein a plurality of projecting portions 89*d* extending in the longitudinal direction are formed on an inner face of the tubular portion 89, a plurality of recessed portions 95*d* engageable with the projecting portions 89*d* are formed in an outer face of the insertion portion 95, and the push member 9 and the cam member 8 are in detent engagement with each other by engagement of the projecting portions 89*d* with the recessed portions 95*d*.

In the retractable writing instrument 1 according to the fifteenth aspect, the configuration described above achieves a structure to more reliably prevent the mutual rotation between the push member 9 and the cam member 8.

A sixteenth aspect of the present invention provides the retractable writing instrument 1 according to the fifteenth aspect, wherein an amount of play between the cam grooves 62 and the engagement projections 84 in a rotation direction is set to be larger than an amount of play between the projecting portions 89*d* and the recessed portions 95*d* in the rotation direction.

In the retractable writing instrument 1 according to the sixteenth aspect, even when a positional deviation in the rotation direction occurs at engagement of the recessed portions 95*d* in an outer face of the push member 9 with the projecting portions 89*d* on an inner face of the cam member 8, the cam grooves 62 in the inner face of the barrel 2 are appropriately engaged with the engagement projections 84 on the outer face of the cam member 8. The configuration described above thus reduces occurrence of sliding failure at the cam grooves 62 and the engagement projections 84.

A seventeenth aspect of the present invention provides the retractable writing instrument 1 according to the fifteenth or sixteenth aspect, wherein the push member 9 includes: the clip 91; a clip base portion 92 that is formed integrally and continuously with a rear portion of the clip 91; and the insertion portion 95 that is formed integrally and continuously with the clip base portion 92, a slide hole 64 extending in the longitudinal direction is formed in a sidewall of the rear end portion of the barrel 2 and is opened rearward at a rear end of the barrel, a front end portion of the clip base portion 92 is inserted into the slide hole 64 in a pen point protruding state, and the front end portion of the clip base portion 92 is located rearward of the slide hole 64 in a pen point retracting state.

In the retractable writing instrument 1 according to the seventeenth aspect, the configuration described above allows a length of the clip base portion 92 in a lengthwise direction to be set at a satisfactory length and improves the durability of the clip.

An eighteenth aspect of the present invention provides a retractable writing instrument 1 comprising: a barrel 2; a writing element 3 that is accommodated in the barrel 2 and is movable in a longitudinal direction; a push member 9 that is disposed on a rear end portion of the barrel 2; and a protruding and retracting mechanism that causes a pen point 31 of the writing element 3 to protrude from and retracting into a front end of the barrel 2 at a frontward press on the push member 9, the protruding and retracting mechanism including: a plurality of cam teeth 61 and a plurality of cam grooves 62 that are formed on and in an inner face of the barrel 2, are arranged alternately along a circumferential direction, and extend in the longitudinal direction; a rotary member 7 that is rotatably disposed rearward of the writing element 3 and includes a plurality of protuberances 75 engageable alternately with the cam teeth 61 or the cam grooves 62; a cam member 8 that is connected to the push member 9 and includes a plurality of cam projections 83 rotating the rotary member 7, and a plurality of engagement projections 84 engaged with the cam grooves 62 in the inner face of the barrel 2 so as to be movable in the longitudinal direction; and a resilient element 10 that biases the writing element 3 rearward, wherein the push member 9 and the cam member 8 are in detent engagement with each other.

In the retractable writing instrument 1 according to the eighteenth aspect, as described above, the engagement projections 84 of the cam member 8 are always engaged with the cam grooves 62 in the inner face of the barrel 2, and the push member 9 and the cam member 8 are always in detent engagement with each other. This configuration reliably prevents the push member 9 from rotating with respect to the barrel 2 even in a pen point retracting state. The push member 9 in the eighteenth aspect may be provided with a clip extending outward in a radial direction from an outer face of the barrel 2 and having a function of pinching an object to be pinched, such as a pocket, in conjunction with the outer face of the barrel 2. Alternatively, the push member 9 in the eighteenth aspect may be provided with a prominence extending in the radial direction from the outer face of the barrel and having no function of pinching an object to be pinched, such as a pocket, in conjunction with the outer face of the barrel. In the eighteenth aspect, the detent engagement may be an engagement structure to prevent mutual rotation between the push member 9 and the cam member 8. Examples of the engagement structure may include: a structure in that a front-end wall of the push member 9 is engaged with a rear-end wall of the cam member 8; a structure in that an inner or outer sidewall of the push member 9 is engaged with an outer or inner sidewall of the cam member 8; and a structure in that the front-end wall of the push member 9 is engaged with the rear-end wall of the cam member 8 and the inner or outer sidewall of the push member 9 is engaged with the outer or inner sidewall of the cam member 8.

A nineteenth aspect of the present invention provides a retractable writing instrument 1 comprising: a barrel 2; a writing element 3 that is accommodated in the barrel 2 and is movable in a longitudinal direction; a push member 9 that is disposed on a rear end portion of the barrel 2 and includes a prominence formed on an outer face of the push member 9 and extending outward in a radial direction; and a protruding and retracting mechanism that causes a pen point 31 of the writing element 3 to protrude from and retracting into a front end of the barrel 2 at a frontward press on the push member 9, the protruding and retracting mechanism including: a plurality of cam teeth 61 and a plurality of cam grooves 62 that are formed on and in an inner face of the barrel 2, are arranged alternately along a circumferential direction, and extend in the longitudinal direction; a rotary member 7 that is rotatably disposed rearward of the writing element 3 and includes a plurality of protuberances 75 engageable alternately with the cam teeth 61 or the cam grooves 62; a cam member 8 that is connected to the push member 9 and includes a plurality of cam projections 83 rotating the rotary member 7, and a plurality of engagement projections 84 engaged with the cam grooves 62 in the inner face of the barrel 2 so as to be movable in the longitudinal direction; and a resilient element 10 that biases the writing element 3 rearward, wherein the push member 9 and the cam member 8 are in detent engagement with each other.

In the retractable writing instrument 1 according to the nineteenth aspect, as described above, the engagement projections 84 of the cam member 8 are always engaged with the cam grooves 62 in the inner face of the barrel 2, and the push member 9 and the cam member 8 are always in detent engagement with each other. This configuration reliably prevents the push member 9 from rotating with respect to the barrel 2 even in a pen point retracting state. The prominence of the push member 9 in the nineteenth aspect may be a prominence extending in a radial direction from an outer face of the barrel and having no function of pinching an object to be pinched, such as a pocket, in conjunction with the outer face of the barrel. Alternatively, the prominence of the push member 9 in the nineteenth aspect may be a clip extending outward in the radial direction from the outer face of the barrel and having a function of pinching an object to be pinched, such as a pocket, in conjunction with the outer face of the barrel. In the nineteenth aspect, the detent engagement may be an engagement structure to prevent mutual rotation between the push member 9 and the cam member 8. Examples of the engagement structure may include: a structure in that a front-end wall of the push member 9 is engaged with a rear-end wall of the cam member 8; a structure in that an inner or outer sidewall of the push member 9 is engaged with an outer or inner sidewall of the cam member 8; and a structure in that the front-end wall of the push member 9 is engaged with the rear-end wall of the cam member 8 and the inner or outer sidewall of the push member 9 is engaged with the outer or inner sidewall of the cam member 8.

An additional aspect of the present invention provides a retractable writing instrument 1 configured as follows. The thermochromic ink 34 is retained in a writing element 3. A pen point 31 from which the thermochromic ink 34 is dischargeable is disposed on a front end of the writing element 3. The writing element 3 is accommodated in a barrel 2 and is movable in a longitudinal direction. A push member 9 is disposed on a rear end portion of the barrel 2. When the push member 9 is pressed frontward, a protruding and retracting mechanism causes the pen point 31 to protrude from the barrel 2 through a front-end hole 41 in the barrel 2. When the push member 9 is pressed frontward again, the protruding and retracting mechanism cancels the pen point protruding state and causes the pen point 31 to retract into the barrel 2 through the front-end hole 41 in the barrel 2. A rub portion 12 is disposed on an outer face of a rear end portion of the push member 9. A writing with the thermochromic ink 34 is rubbed with the rub portion 12 and is thermally discolored by frictional heat generated at the time of rubbing.

The push member 9 includes a main body 93 that is insertable into the rear end portion of the barrel 2, and a prominence 92 that is formed on an outer face of the main body 93 and extends outward in a radial direction.

A slide hole 64 extending in the longitudinal direction is formed in a sidewall of the rear end portion of the barrel 2 and is opened rearward at a rear end of the barrel 2. In the pen point protruding state, a front end portion of the prominence 92 is inserted into the slide hole 64. In a pen point retracting state, the front end portion of the prominence 92 is located rearward of the slide hole 64.

A guide groove 65 extending in the longitudinal direction is formed in an inner face of the sidewall of the rear end portion of the barrel 2 and is opened rearward at the rear end of the barrel.

A guide projection 93*a* is formed on an outer face of the main body 93 of the push member 9 and is engageable with the guide groove 65 in a circumferential direction. In the pen point retracting state, the push member 9 is rotatable with respect to the barrel 2.

In a state in which the guide projection 93*a* is engaged with the guide groove 65, the prominence 92 is inserted into the slide hole 64, and the push member 9 is movable in the longitudinal direction.

In a state in which the guide projection 93*a* is disengaged from the guide groove 65, the prominence 92 of the push member 9 is restricted at the rear end of the barrel 2. The movement of the push member 9 in the longitudinal direction is thus inhibited.

In the retractable writing instrument 1 according to the present aspect, the protruding and retracting mechanism includes: a plurality of cam teeth 61 and a plurality of cam grooves 62 that are formed on and in an inner face of the barrel 2, are arranged alternately along the circumferential direction, and extend in the longitudinal direction; a rotary member 7 that is rotatably disposed rearward of the writing element 3 and includes a plurality of protuberances 75 engageable alternately with the cam teeth 61 or the cam grooves 62; a cam member 8 that is connected to the push member 9 and includes a plurality of cam projections 83 rotating the rotary member 7, and a plurality of engagement projections 84 engaged with the cam grooves 62 in the inner face of the barrel 2 so as to be movable in the longitudinal direction; and a resilient element 10 that biases the writing element 3 rearward.

A push member-specific resilient element 11 is disposed between the rotary member 7 and the cam member 8. The push member-specific resilient element 11 has a front end portion that is locked at a locking portion 77 on an inner face of the rotary member 7, and a rear end portion that is locked at a locking portion 81*b* on an inner face of the cam member 8.

The push member-specific resilient element 11 always biases rearward the push member 9 connected to the cam member 8. Also in the pen point protruding state, therefore, the prominence 92 of the push member 9 is separated from the slide hole 64 and is located rearward of the slide hole 64. The push member 9 is thus rotated in both the pen point protruding state and the pen point retracting state. The rubbing operation is therefore started quickly.

A resilient force of the push member-specific resilient element 11 is preferably set to be smaller than a resilient force of the resilient element 10.

Advantageous Effect of Invention

A retractable writing instrument according to the present invention reliably prevents a push member including a clip from rotating with respect to a barrel even in a pen point retracting state.

DESCRIPTION OF EMBODIMENTS

<First Embodiment>

Figure 1:
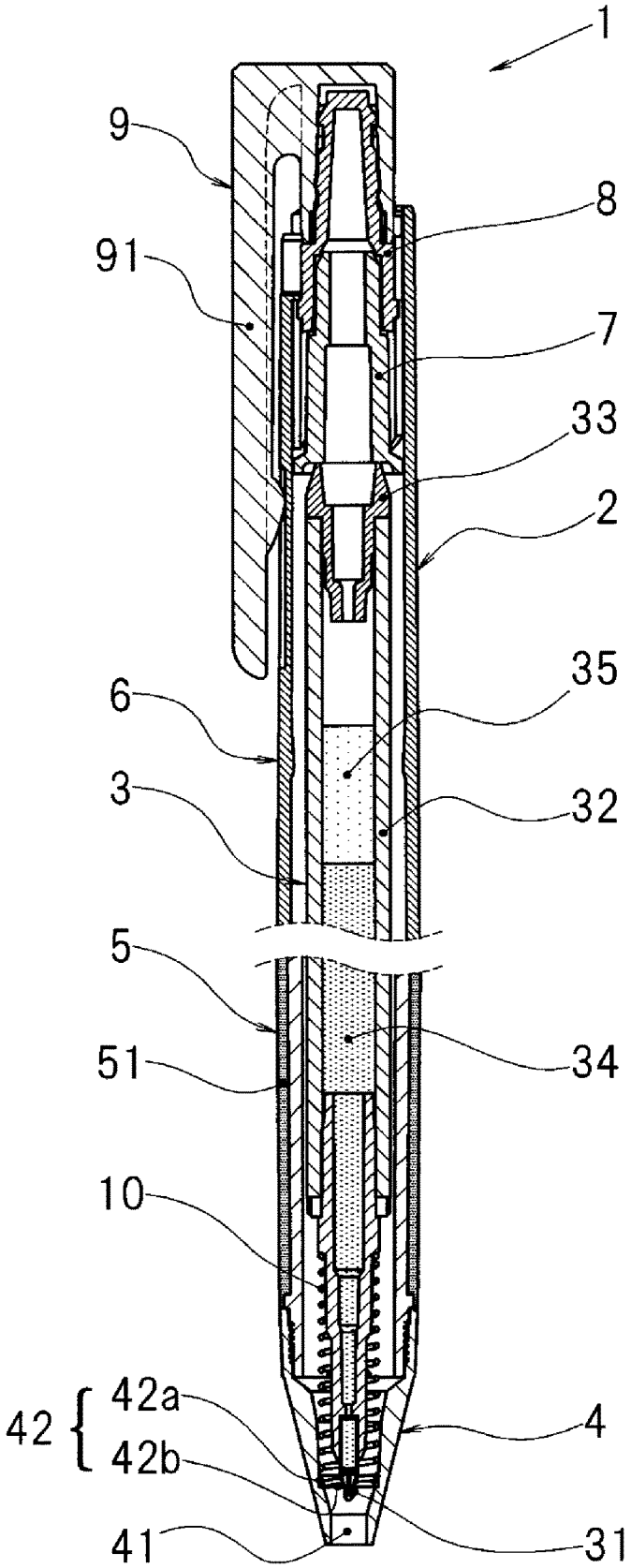
FIG. 1 is a longitudinal sectional view illustrating a pen point retracting state in a first embodiment of the present invention.
Figure 2:
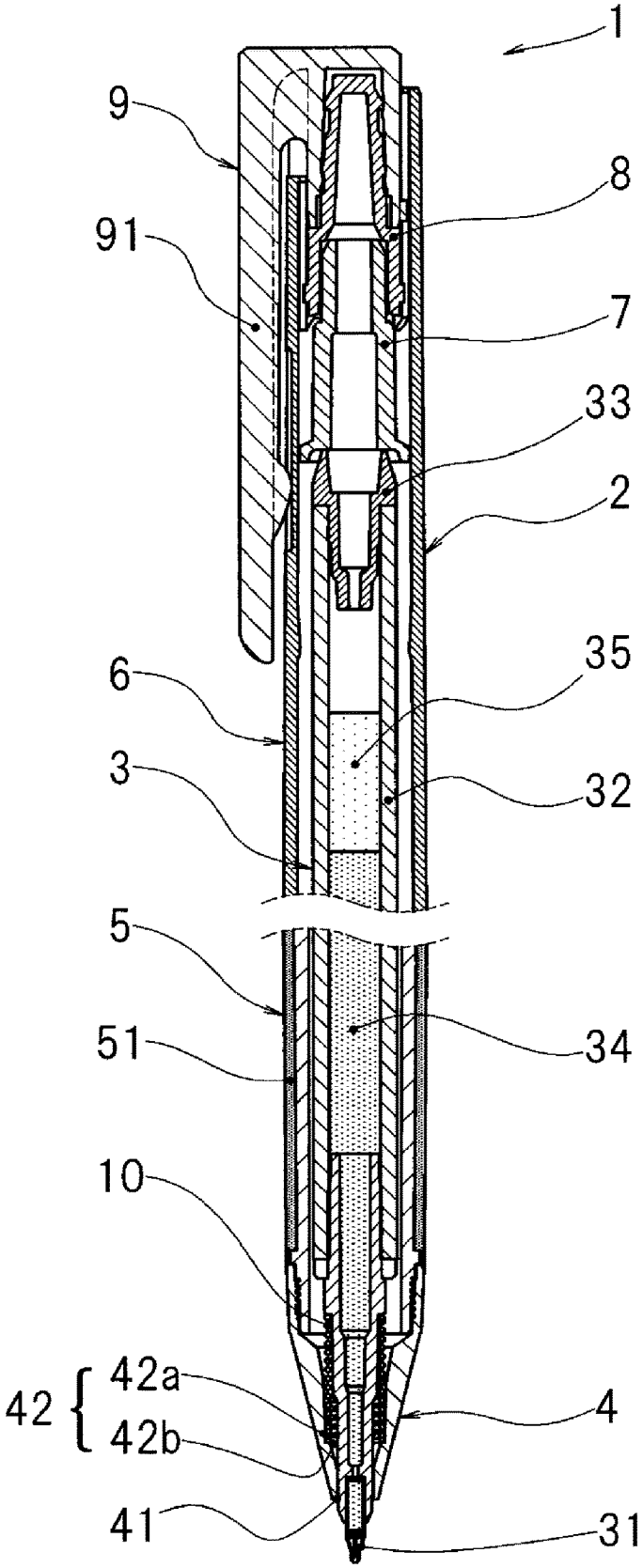
FIG. 2 is a longitudinal sectional view illustrating a pen point protruding state in the first embodiment of the present invention.
Figure 3:
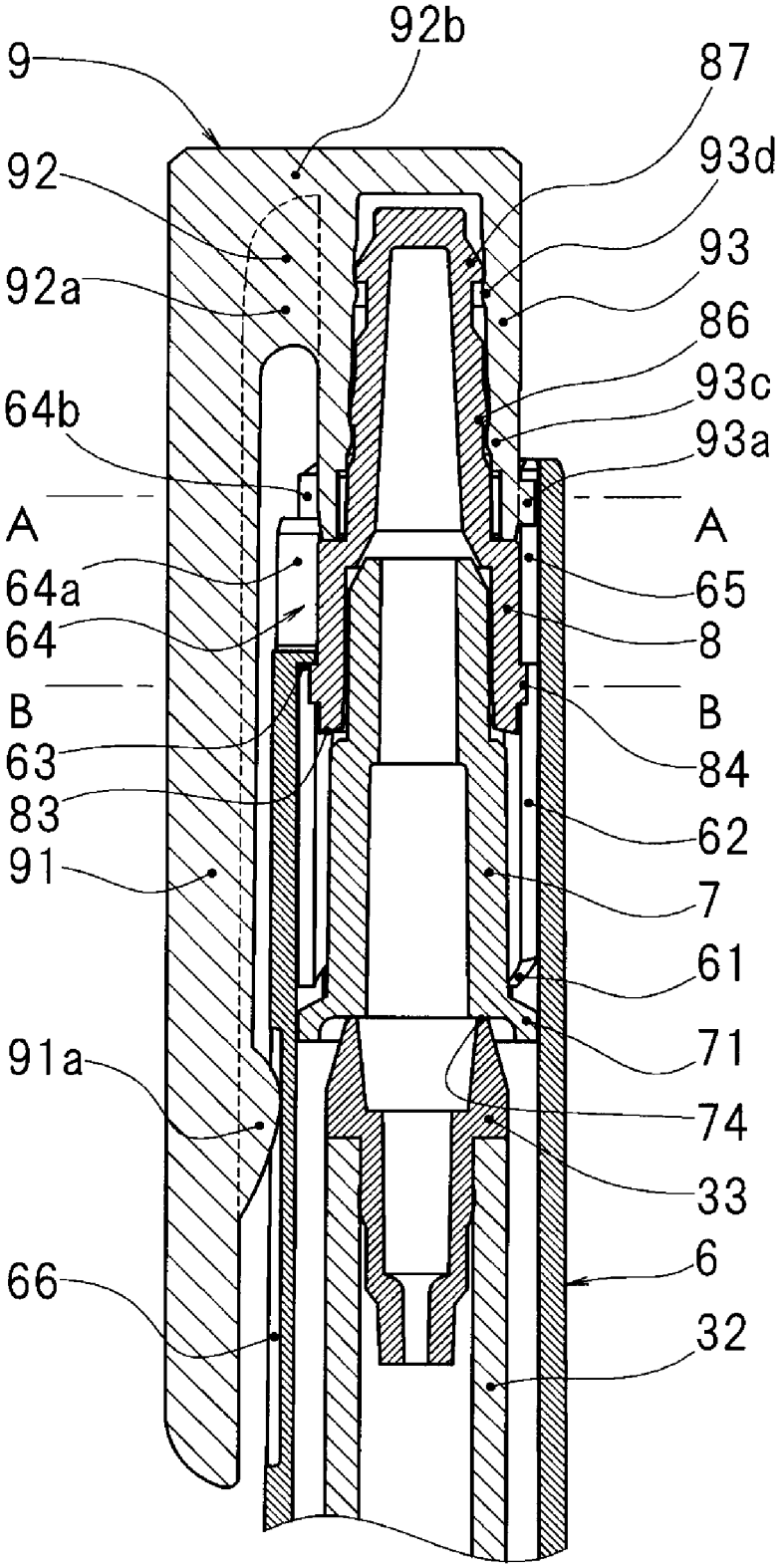
FIG. 3 is an enlarged longitudinal sectional view of a main part in FIG. 1.
Figure 4:
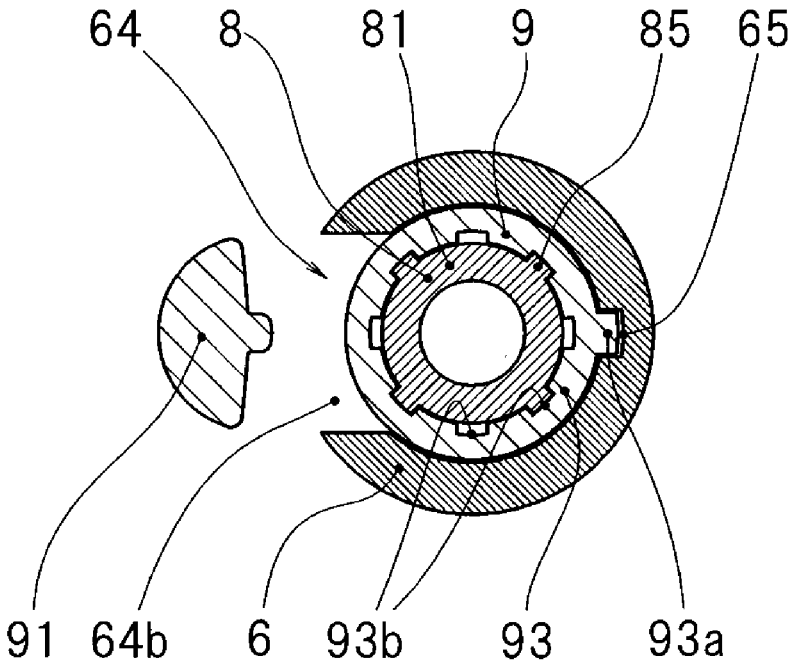
FIG. 4 is an enlarged sectional view taken along line A-A in FIG. 3.
Figure 5:
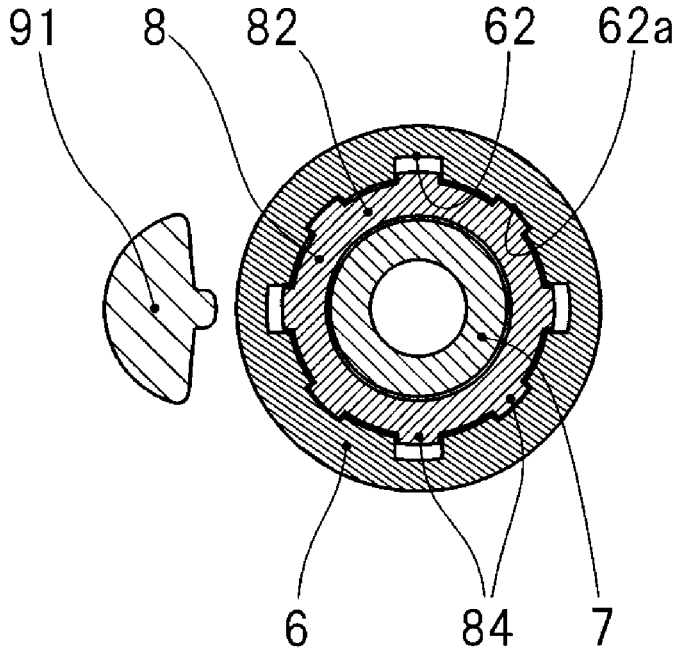
FIG. 5 is an enlarged sectional view taken along line B-B in FIG. 3.
Figure 6:
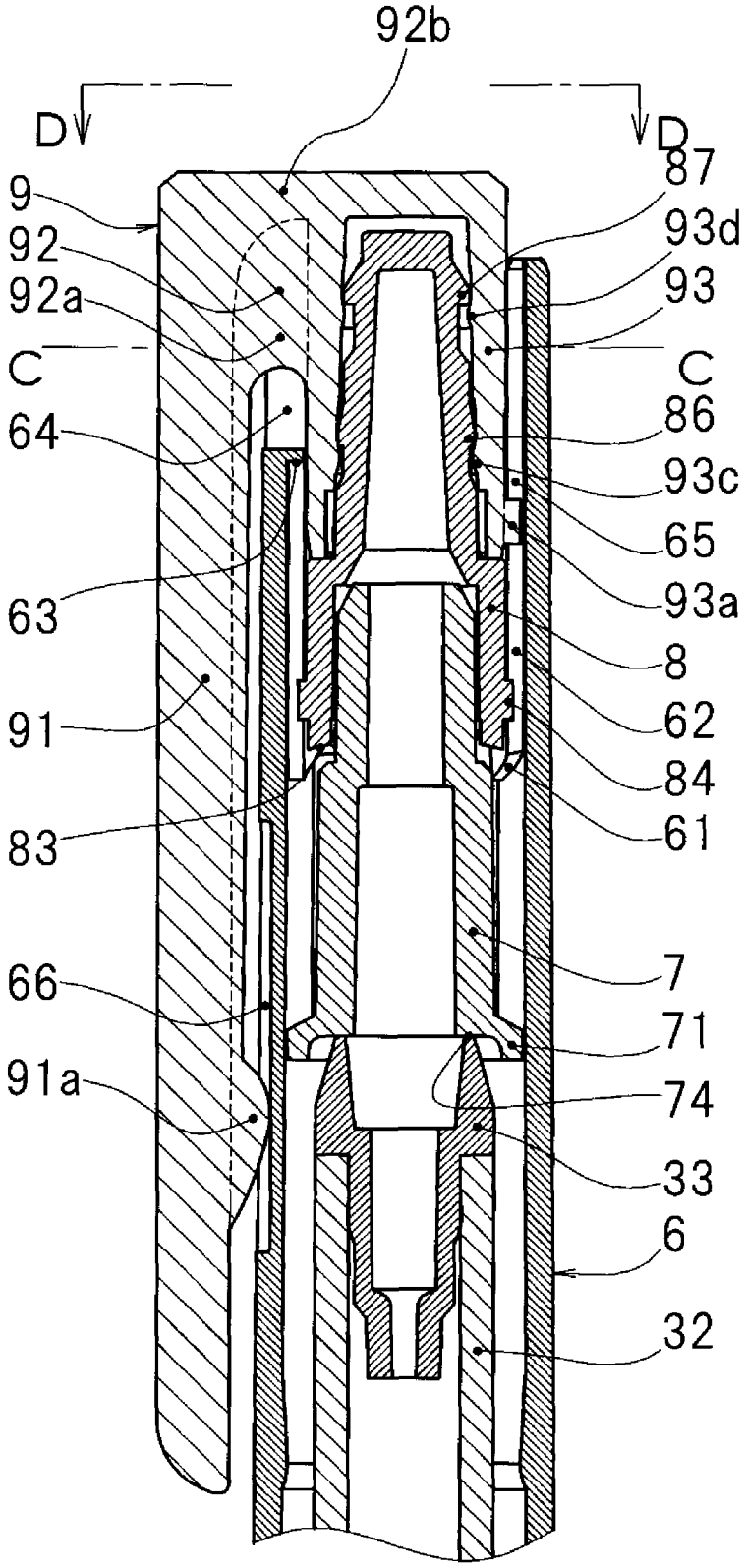
FIG. 6 is an enlarged longitudinal sectional view of a main part in FIG. 2.
Figure 7:
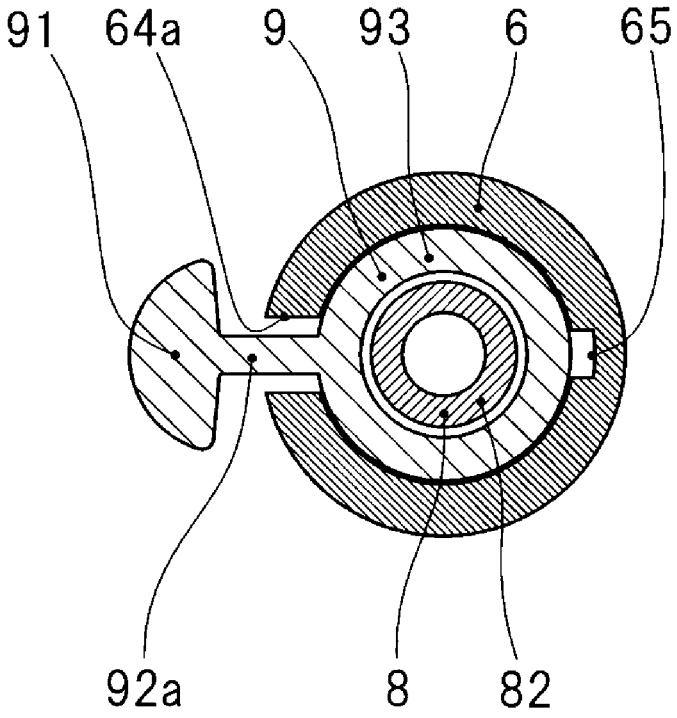
FIG. 7 is an enlarged sectional view taken along line C-C in FIG. 6.
Figure 8:
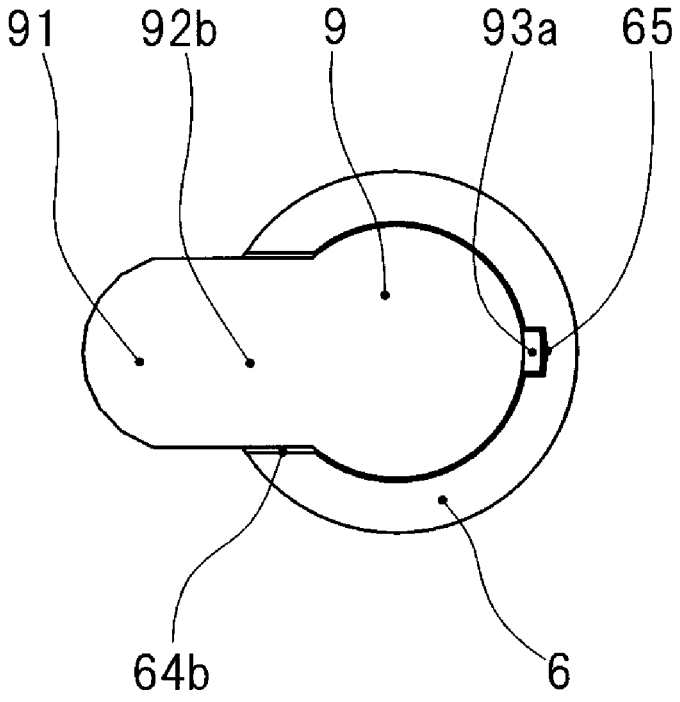
FIG. 8 is a view seen along arrow D-D in FIG. 6.
Figure 9:
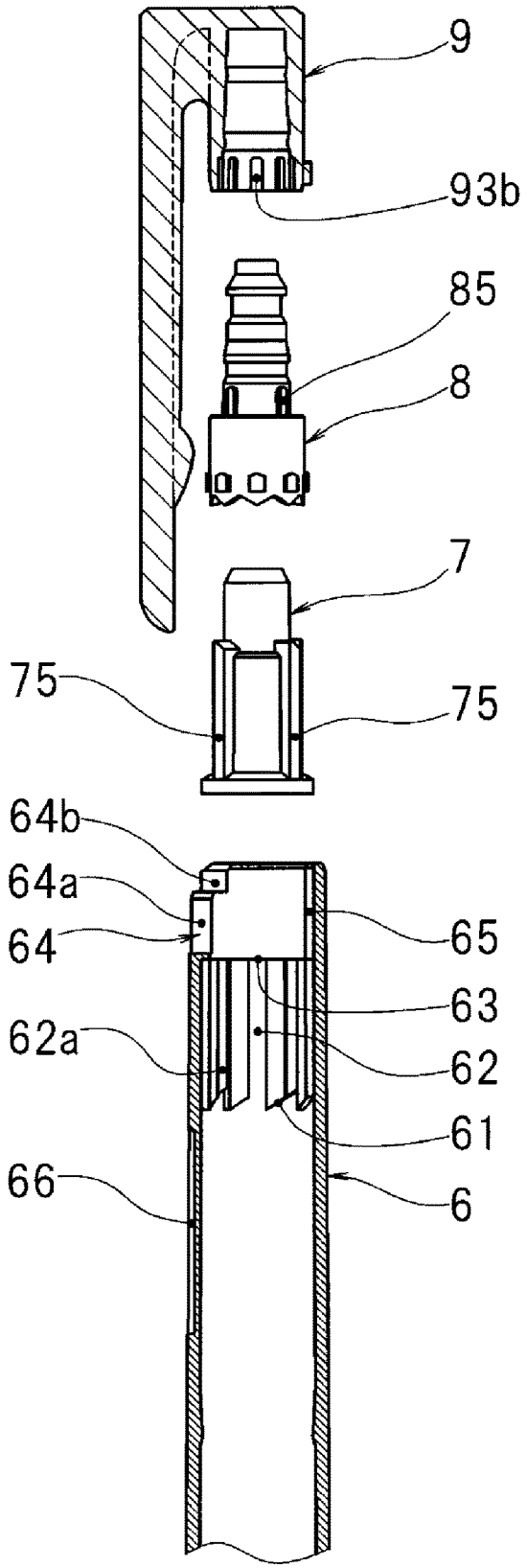
FIG. 9 is an exploded view illustrating main components of a protruding and retracting mechanism in the first embodiment of the present invention.
Figure 10:
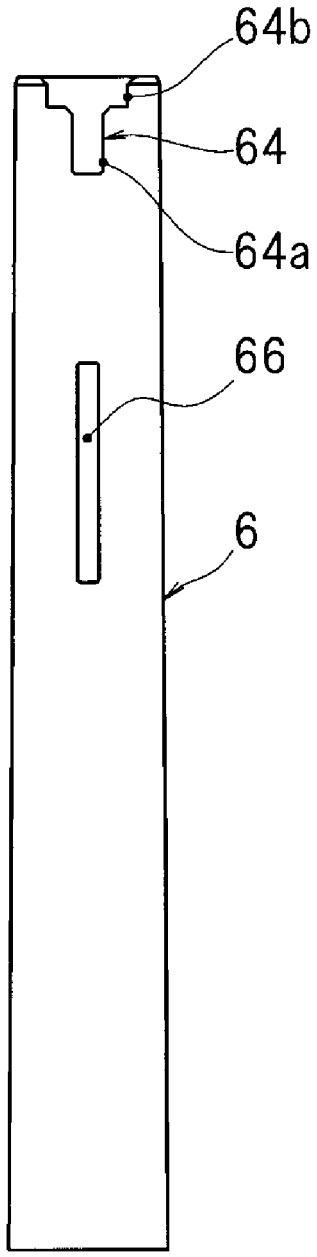
FIG. 10 is a front view of a rear barrel in the first embodiment of the present invention.
Figure 11:
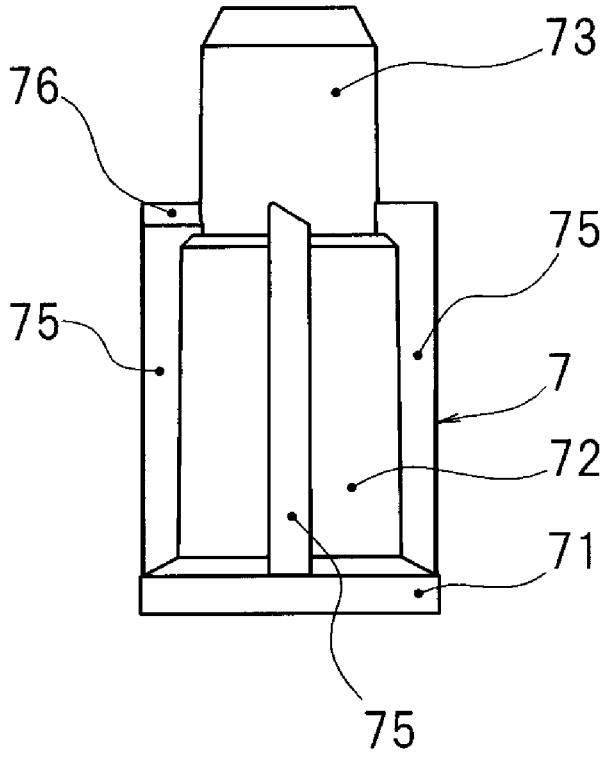
FIG. 11 is a front view of a rotary member in the first embodiment of the present invention.
Figure 12:
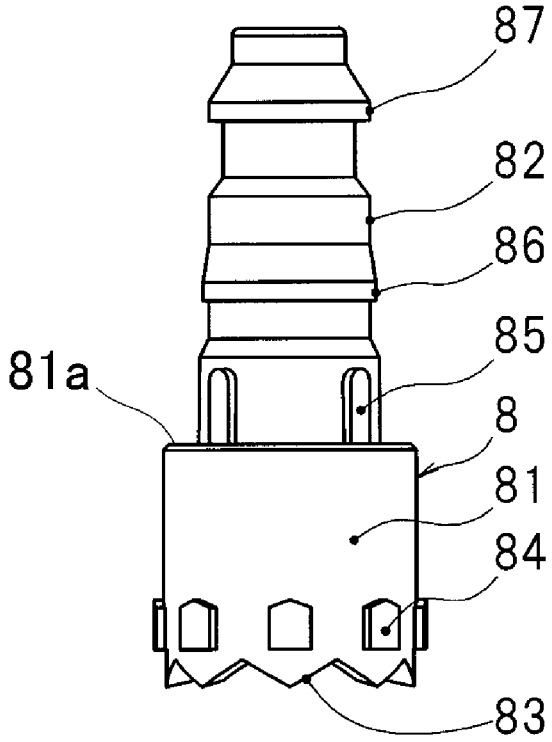
FIG. 12 is a front view of a cam member in the first embodiment of the present invention.
Figure 13:
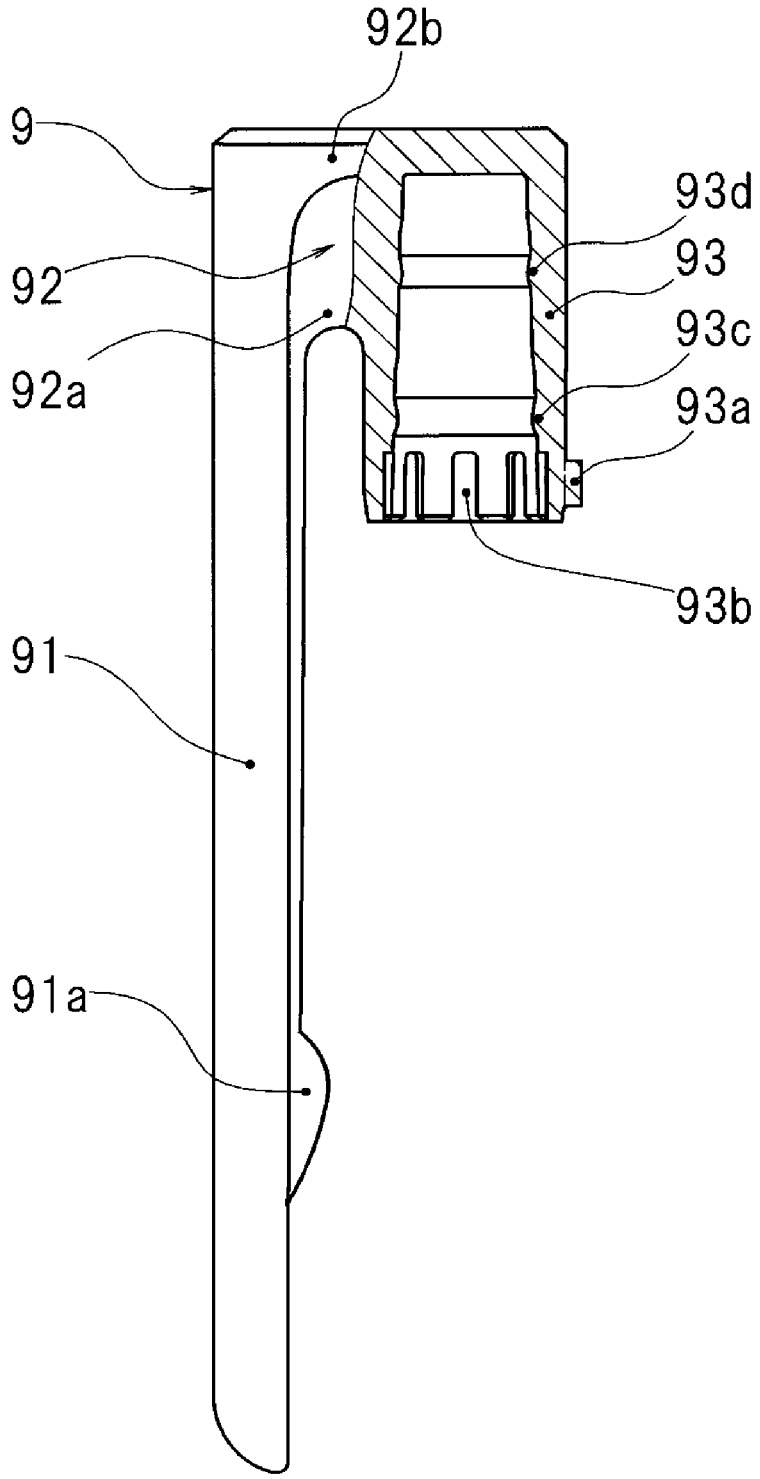
FIG. 13 is a longitudinal sectional view of a part of a push member in the first embodiment of the present invention.

A retractable writing instrument according to a first embodiment of the present invention will be described with reference to the drawings (see FIGS. 1 to 15).

A retractable writing instrument 1 according to the present embodiment includes a barrel 2, a writing element 3 and a protruding and retracting mechanism. The writing element 3 is accommodated in the barrel 2. The protruding and retracting mechanism causes a pen point 31 of the writing element 3 to protrude from and retract into the barrel 2 through a front-end hole 41 in the barrel 2.

The writing element 3 includes the pen point 31, a reservoir 32, ink 34 and a follower 35. The reservoir 32 has a front-end opening to which the pen point 31 is fixed by press fitting. The ink 34 is filled in the reservoir 32. The follower 35 (e.g., a high viscous fluid) is filled subsequent to the ink 34 and moves frontward with consumption of the ink 34.

For example, the pen point 31 may have either a configuration composed of only a ballpoint pen that is made of metal and enfolds a ball in a rotatable manner at a front end thereof or a configuration composed of a pen point holder that is made of synthetic resin and holds an outer face of a rear portion of a ballpoint pen tip. The writing element 3 also includes a tail plug 33. The tail plug 33 is attached to a rear-end opening of the reservoir 32 and has a vent for ventilation from the reservoir 32 to the outside.

Barrel

The barrel 2 includes a front barrel 4, a middle barrel 5 and a rear barrel 6. The middle barrel 5 is connected to a rear end portion of the front barrel 4. The rear barrel 6 is connected to a rear end portion of the middle barrel 5.

The front barrel 4 is a tapered cylindrical body made of metal or synthetic resin. The front barrel 4 has the front-end hole 41 through which the pen point 31 protrudes and retracts. The front-end hole 41 is formed in a front end of the front barrel 4 and penetrates the front barrel 4 in an axial direction. The front barrel 4 also has a resilient element holding portion 42. The resilient element holding portion 42 is formed integrally with an inner face of the front barrel 4. The resilient element holding portion 42 includes a holding wall portion 42*a* to which an outer peripheral face of a front end portion of a resilient element 10 is fitted, and a locking step portion 42*b* at which the front end of the resilient element 10 is locked. The front barrel 4 also has a female screw portion. The female screw portion is formed on an inner face of a rear-end opening of the front barrel 4.

The middle barrel 5 is a cylindrical body made of synthetic resin and having both ends opened. The middle barrel 5 has a male screw portion. The male screw portion is formed on an outer face of a front end portion of the middle barrel 5. The male screw portion is screwable into the female screw portion of the front barrel 4. The middle barrel 5 also has a male screw portion. The male screw portion is formed on an outer face of a rear end portion of the middle barrel 5. The male screw portion is screwable into a female screw portion of the rear barrel 6. The middle barrel 5 also has a grip portion 51. The grip portion 51 is made of elastic material and is formed on an outer face of a middle portion of the middle barrel 5. The grip portion 51 is provided on an outer face of the middle barrel 5 by double molding or as a separate member attached to the front barrel 4.

The rear barrel 6 is a cylindrical body made of synthetic resin and having both ends opened. The rear barrel 6 has the female screw portion. The female screw portion is formed on an inner face of a front-end opening of the rear barrel 6. The male screw portion on the outer face of the rear end portion of the middle barrel 5 is screwable into the female screw portion. The rear barrel 6 also has a plurality (e.g., four) of cam teeth 61 and a plurality (e.g., four) of cam grooves 62. The cam teeth 61 and the cam grooves 62 are formed integrally with an inner face of a rear portion of the rear barrel 6 and extend in a longitudinal direction. The cam teeth 61 and the cam grooves 62 are arranged alternately along a circumferential direction. The rear barrel 6 also has cam guide grooves 62*a*. The cam guide grooves 62*a* are formed in the respective cam teeth 61 and extend in the longitudinal direction. The cam guide grooves 62*a* and the cam grooves 62 are spaced evenly and arranged alternately along the circumferential direction. The rear barrel 6 also has a locking wall portion 63 that is formed integrally with rear ends of the cam grooves 62. The rear barrel 6 also has a slide hole 64 extending in the longitudinal direction. The slide hole 64 is formed in a sidewall of the rear barrel 6 and is located rearward of the locking wall portion 63. In addition, the slide hole 64 is opened rearward at a rear end of the rear barrel 6. The rear barrel 6 also has one guide groove 65 extending in the longitudinal direction. The guide groove 65 is formed in an inner face of a rear-end opening of the rear barrel 6 and is located opposite the slide hole 64. The guide groove 65 penetrates the locking wall portion 63 and communicates with one of the cam grooves 62. The slide hole 64 includes a narrower front-side hole 64*a* and a wider rear-side hole 64*b* that communicates with the front-side hole 64*a* and is opened rearward. The rear barrel 6 also has a slide groove 66. The slide groove 66 is formed frontward of the slide hole 64 and is engageable with a projected bump 91*a* of a clip 91. A length of the slide groove 66 in the longitudinal direction corresponds to a push stroke of a push member 9. On the other hand, a length of the slide hole 64 in the longitudinal direction does not correspond to the push stroke of the push member 9 and is shorter than the length of the slide groove 66 in the longitudinal direction. A lengthwise size of the barrel 2 rearward of the cam grooves 62 is thus set to be shorter, resulting in an increase of the degree of freedom about design of the push member 9 and barrel 2.

Protruding and Retracting Mechanism

The protruding and retracting mechanism is a push-type protruding and retracting mechanism employing a rotary cam mechanism. The protruding and retracting mechanism includes the cam teeth 61 and cam grooves 62, a rotary member 7, a cam member 8, the push member 9 and the resilient element 10. The cam teeth 61 and the cam grooves 62 are formed on and in the inner face of the barrel 2 (the inner face of the rear barrel 6). The rotary member 7 engages with the cam teeth 61 or the cam grooves 62 and abuts against a rear end of the writing element 3. The cam member 8 engages with the rotary member 7 and the cam grooves 62. The push member 9 is connected to the cam member 8. The resilient element 10 (e.g., a compression coil spring) is accommodated in the barrel 2 and biases the writing element 3 rearward. The protruding and retracting mechanism in the present embodiment is of a double push type that the push member 9 is pressed frontward by both a pen point protruding operation and a pen point retracting operation.

Rotary Member

The rotary member 7 is a cylindrical body made of synthetic resin and having both ends opened. The rotary member 7 has an annular flange portion 71. The annular flange portion 71 is formed on a front end portion of the rotary member 7. The rotary member 7 also has a large-diameter tube portion 72. The large-diameter tube portion 72 is formed rearward of the annular flange portion 71 of the rotary member 7. The rotary member 7 also has a small-diameter tube portion 73 smaller in outer diameter than the large-diameter tube portion 72. The small-diameter tube portion 73 is formed rearward of the large-diameter tube portion 72 of the rotary member 7. The rotary member 7 also has a step portion 74. The step portion 74 is formed on an inner face of the front end portion of the rotary member 7. The rear end of the writing element 3 (the tail plug 33 attached to the rear end of the writing element 3) abuts against the step portion 74. The rotary member 7 also has a plurality (e.g., four) of protuberances 75. The protuberances 75 are formed on an outer face of the large-diameter tube portion 72 (at a position rearward of the annular flange portion 71 and frontward of the small-diameter tube portion 73). The protuberances 75 are engageable with the cam grooves 62 and extend in the longitudinal direction. The rotary member 7 also has cam slopes 76. The cam slopes 76 are formed on rear ends of the protuberances 75 and are abuttable against the cam teeth 61 and cam projections 83 of the cam member 8. The small-diameter tube portion 73 is inserted with play into an inner face of a front end portion of the cam member 8 (an inner face of a large-diameter front portion 81).

Cam Member

Figure 14:
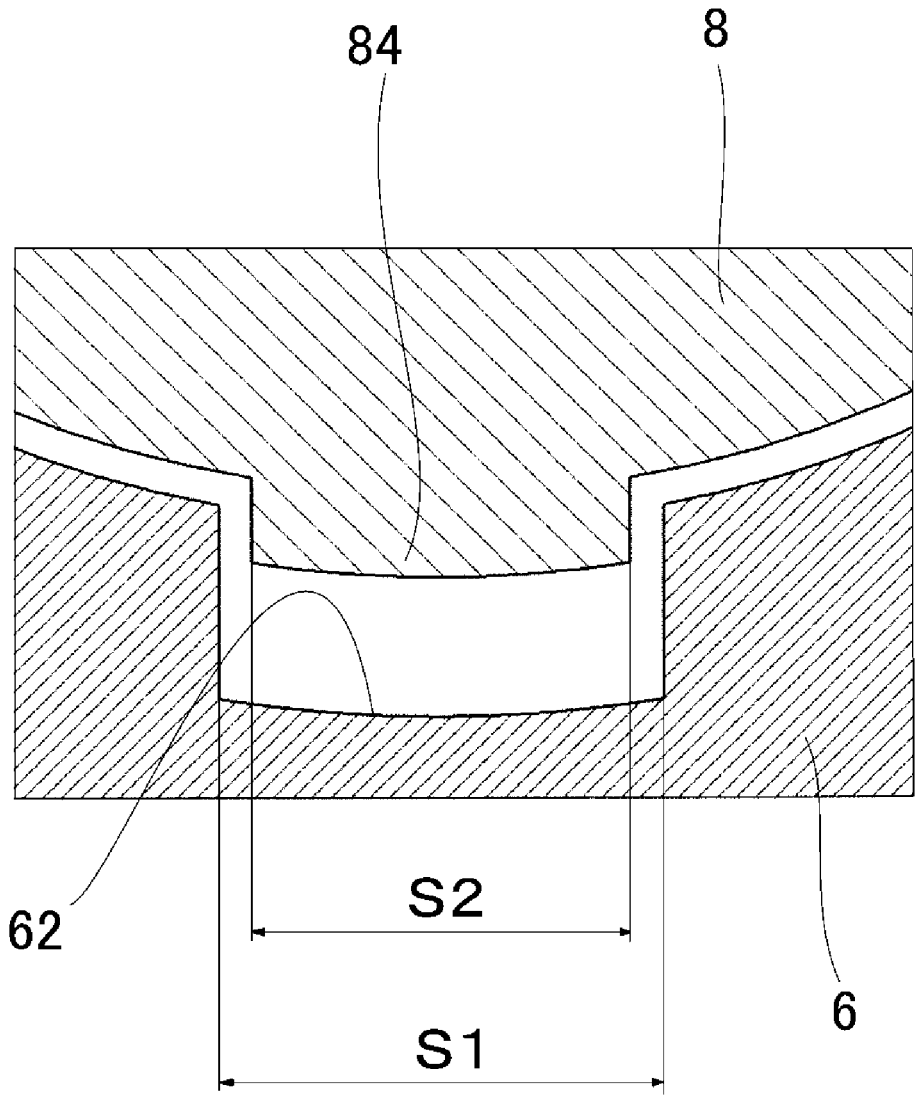
FIG. 14 is an enlarged sectional view of a main part in FIG. 5 and illustrates an engagement state between an engagement projection and a cam groove in the first embodiment of the present invention.

The cam member 8 is a one-end closed cylindrical body made of synthetic resin. In other words, the cam member 8 has a front end that is opened and a rear end that is closed. The cam member 8 has the large-diameter front portion 81 and a small-diameter rear portion 82 (insertion portion) smaller in outer diameter than the front portion 81. The rear portion 82 is formed integrally and continuously with the front portion 81 and is located rearward of the front portion 81. The cam member 8 also has the plurality (e.g., eight) of cam projections 83. The cam projections 83 are formed on a front end face of the cam member 8 (a front end face of the large-diameter front portion 81). The cam projections 83 are also formed circumferentially and continuously in a saw-tooth shape (a chevron shape). The cam member 8 also has a plurality (e.g., eight) of engagement projections 84. The engagement projections 84 are formed on an outer face of a front end portion of the cam member 8 (an outer face of a front end portion of the large-diameter front portion 81). The engagement projections 84 are also formed discretely along the circumferential direction. The engagement projections 84 are respectively located rearward of the cam projections 83. In the pen point retracting state, the engagement projections 84 are locked at the locking wall portion 63 in the longitudinal direction. The engagement projections 84 are engaged with the cam grooves 62 with an amount of play in a rotation direction. The engagement projections 84 are also engaged with the cam guide grooves 62*a* with an amount of play in the rotation direction. As illustrated in FIG. 14, specifically, a widthwise size S1 of each cam groove 62 is different from a widthwise size S2 of each engagement projection 84 by 0.19 mm. Likewise, a widthwise size of each cam guide groove 62*a* is different from the widthwise size of each engagement projection 84 by 0.19 mm. Preferably, this amount of play (S1-S2) is set within a range from 0.16 to 0.25 mm. More preferably, this amount of play (S1-S2) is set within a range from 0.18 to 0.21 mm. However, this amount of play (0.19 mm) is illustrative, and any other value may be employed for this amount of play.

The cam member 8 also has a plurality (e.g., four) of projecting portions 85 extending in the longitudinal direction. The projecting portions 85 are formed on an outer face of a front end portion (an outer face of a base portion) of the small-diameter rear portion 82 (insertion portion) in the cam member 8. The projecting portions 85 are spaced evenly along the circumferential direction. The cam member 8 also has a first outward projection 86. The first outward projection 86 is formed on the outer face of the small-diameter rear portion 82 (insertion portion) and is located rearward of the projecting portions 85. The cam member 8 also has a second outward projection 87. The second outward projection 87 is formed on the outer face of the small-diameter rear portion 82 (insertion portion) and is located rearward of the first outward projection 86. Each of the first outward projection 86 and the second outward projection 87 is constituted of an annular projection or a plurality of discrete projections. The first outward projection 86 is set to be larger in outer diameter than the second outward projection 87. The small-diameter rear portion 82 (insertion portion) is thus smoothly and easily inserted into a tubular portion 93.

Push Member

The push member 9 includes the clip 91, a clip base portion 92 and the one-end closed tubular portion 93, and is made of synthetic resin. The clip 91 extends in the longitudinal direction. The clip base portion 92 is formed integrally and continuously with a rear portion of the clip 91. The tubular portion 93 is formed integrally and continuously with the clip base portion 92. The projected bump 91*a* is formed integrally with an inner face of the clip 91 so as to protrude from the inner face of the clip 91. The clip base portion 92 includes a plate-shaped first connection wall portion 92*a* and a plate-shaped second connection wall portion 92*b*. The first connection wall portion 92*a* extends in the longitudinal direction. The second connection wall portion 92*b* is formed integrally and continuously with a rear end of the first connection wall portion 92*a* and extends in a direction perpendicular to an axis. This configuration improves the durability of the clip base portion 92. The projected bump 91*a* of the clip 91 is formed on a plate shape extending in the longitudinal direction, and is engaged with the slide groove 66 in the outer face of the rear barrel 6 so as to be movable in the longitudinal direction. This configuration prevents rotation of the clip 91.

The clip base portion 92 is insertable into the slide hole 64. When the push member 9 is pressed frontward in transition from the pen point retracting state to the pen point protruding state, the first connection wall portion 92*a* is inserted into the narrower front-side hole 64*a* of the slide hole 64, and the second connection wall portion 92*b* is inserted into the wider rear-side hole 64*b* of the slide hole 64. This configuration further prevents rotation of the clip 91 at the time when the push member 9 is pressed frontward.

The push member 9 has one guide projection 93*a*. The guide projection 93*a* is formed integrally with an outer face of the tubular portion 93 and is located opposite the clip base portion 92 in a radial direction. The push member 9 also has a plurality (e.g., eight) of recessed portions 93*b* extending in the longitudinal direction. The recessed portions 93*b* are formed in an inner face of a front-end opening of the tubular portion 93. The recessed portions 93*b* are spaced evenly along the circumferential direction. Each of the recessed portions 93*b* is opened frontward from a front end of the tubular portion 93. The push member 9 also has a first inward projection 93*c*. The first inward projection 93*c* is formed on an inner face of the tubular portion 93 and is located rearward of the recessed portions 93*b*. The push member 9 also has a second inward projection 93*d*. The second inward projection 93*d* is formed on the inner face of the tubular portion 93 and is located rearward of the first inward projection 93*c*. Each of the first inward projection 93*c* and the second inward projection 93*d* is constituted of an annular projection or a plurality of discrete projections. The first inward projection 93*c* is set to be larger in inner diameter than the second inward projection 93*d*. The small-diameter rear portion 82 (insertion portion) is thus smoothly and easily inserted into the tubular portion 93. The clip 91, the clip base portion 92 (the second connection wall portion 92*b*) and the tubular portion 93 respectively have rear end faces that are flush with one another and are defined as a press operation face (push face).

Figure 15:
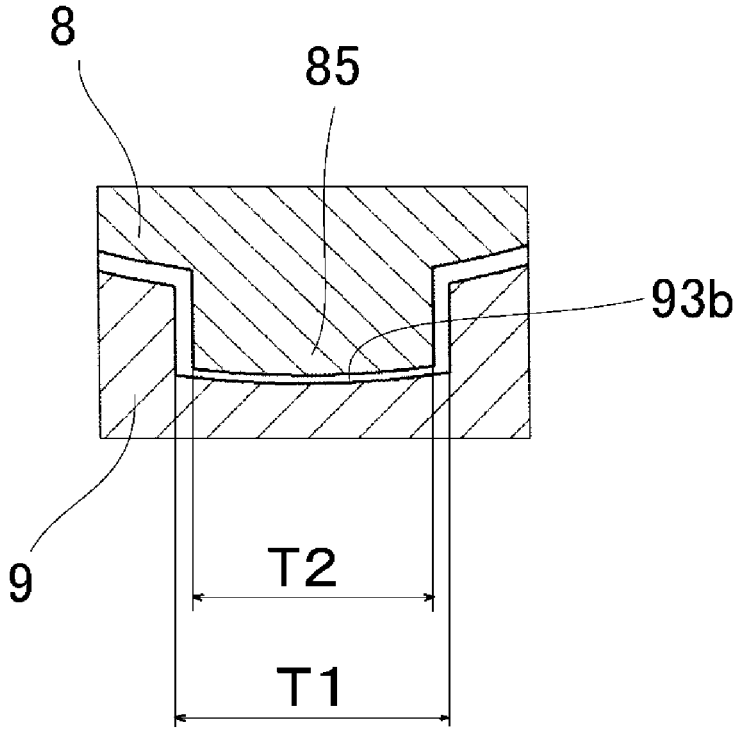
FIG. 15 is an enlarged sectional view of a main part in FIG. 4 and illustrates an engagement state between a projecting portion and a recessed portion in the first embodiment of the present invention.
Figure 16:
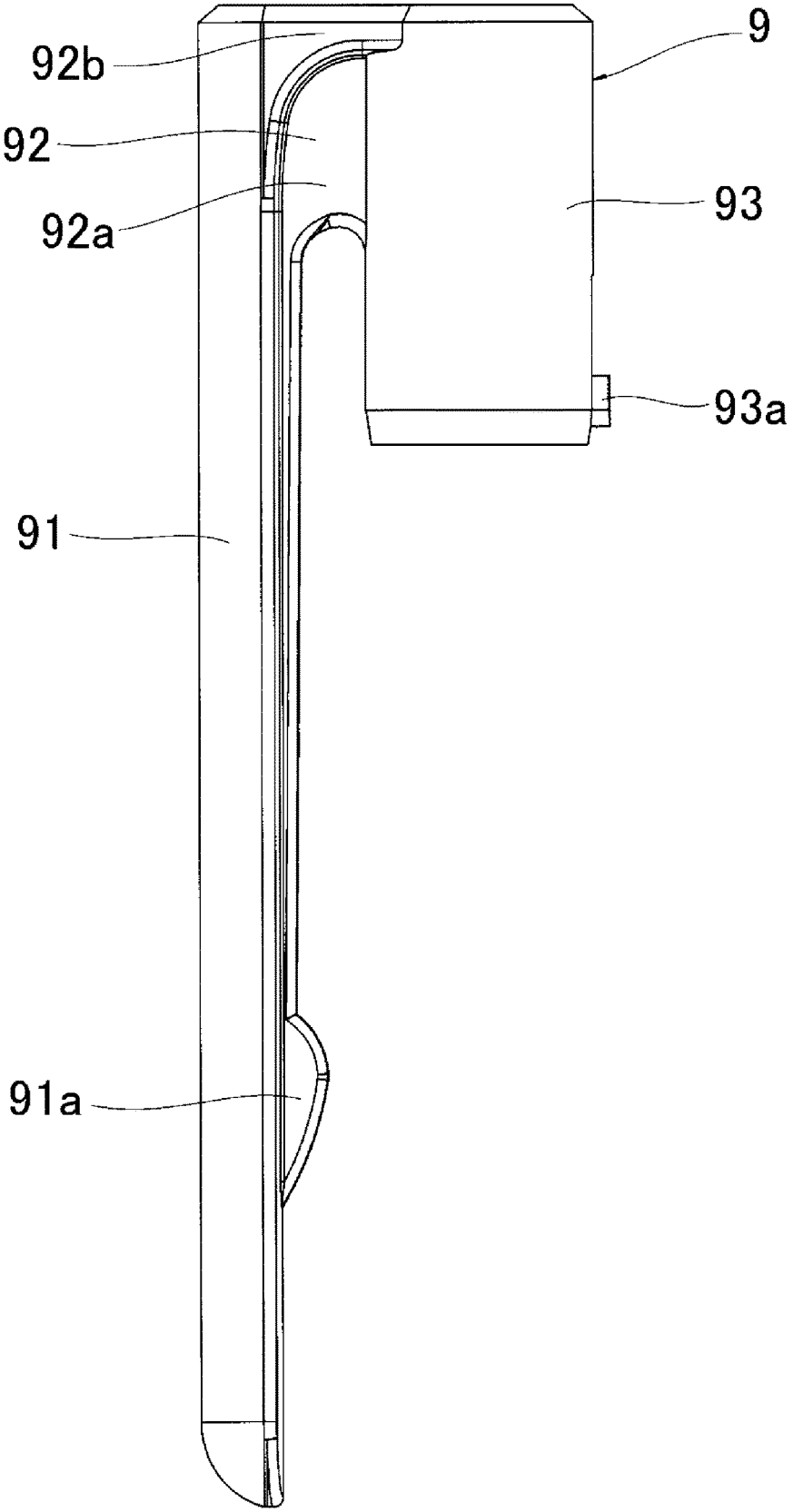
FIG. 16 is a side view of a push member in a second embodiment of the present invention.
Figure 17:
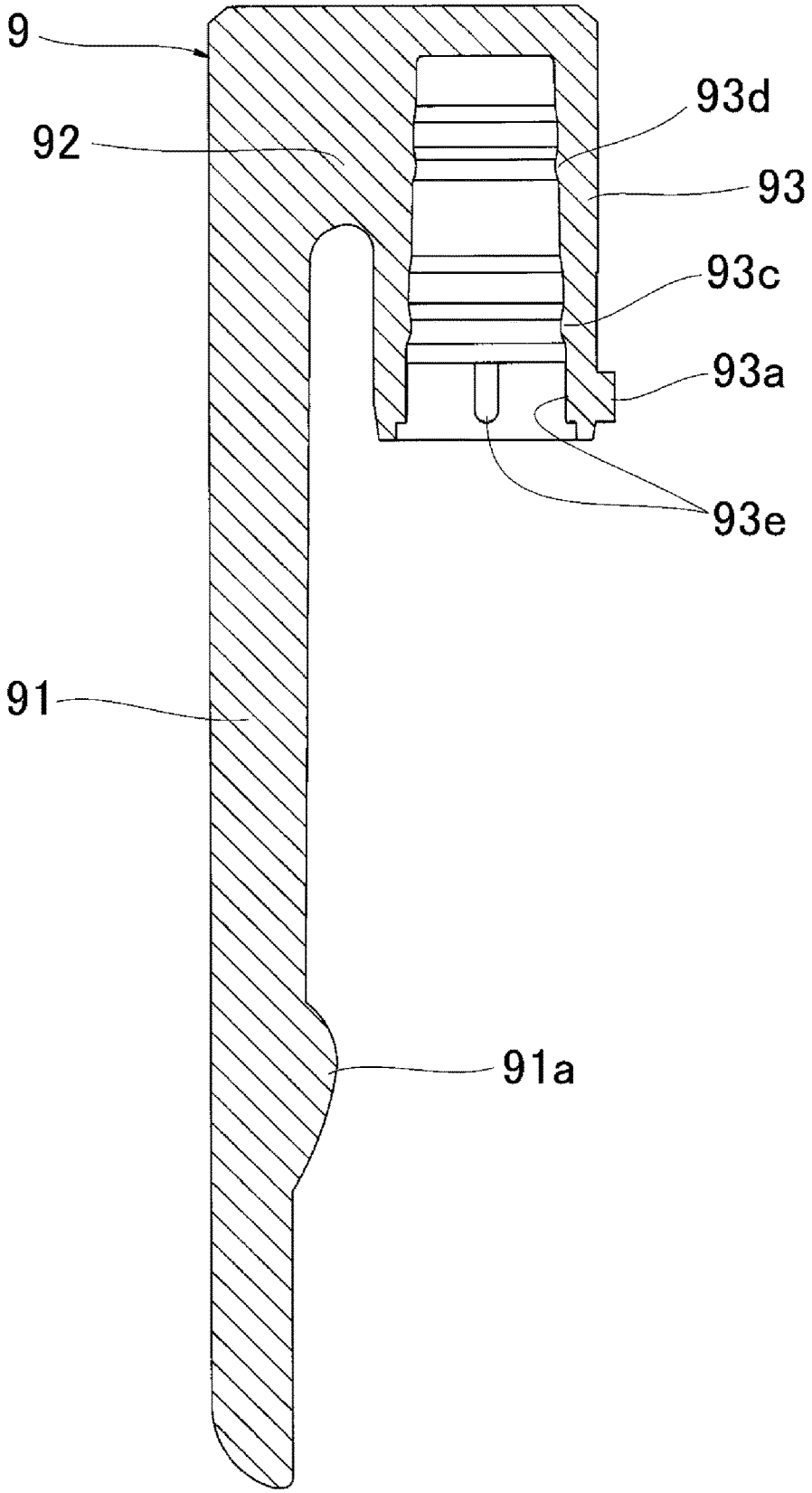
FIG. 17 is a longitudinal sectional view of the push member in the second embodiment of the present invention.
Figure 18:
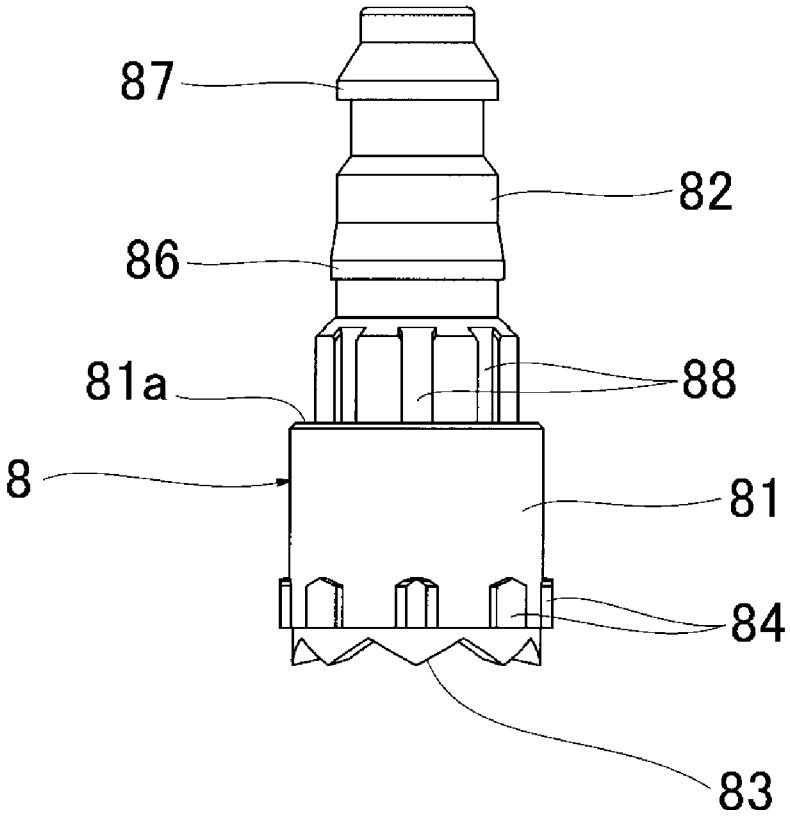
FIG. 18 is a front view of a cam member in the second embodiment of the present invention.
Figure 19:
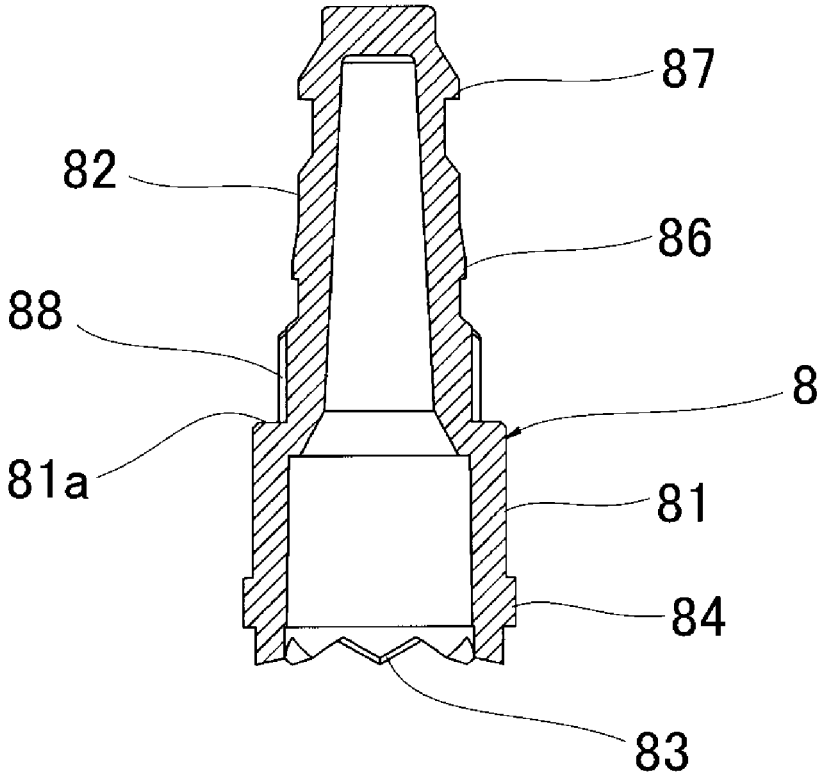
FIG. 19 is a longitudinal sectional view of the cam member in the second embodiment of the present invention.
Figure 20:
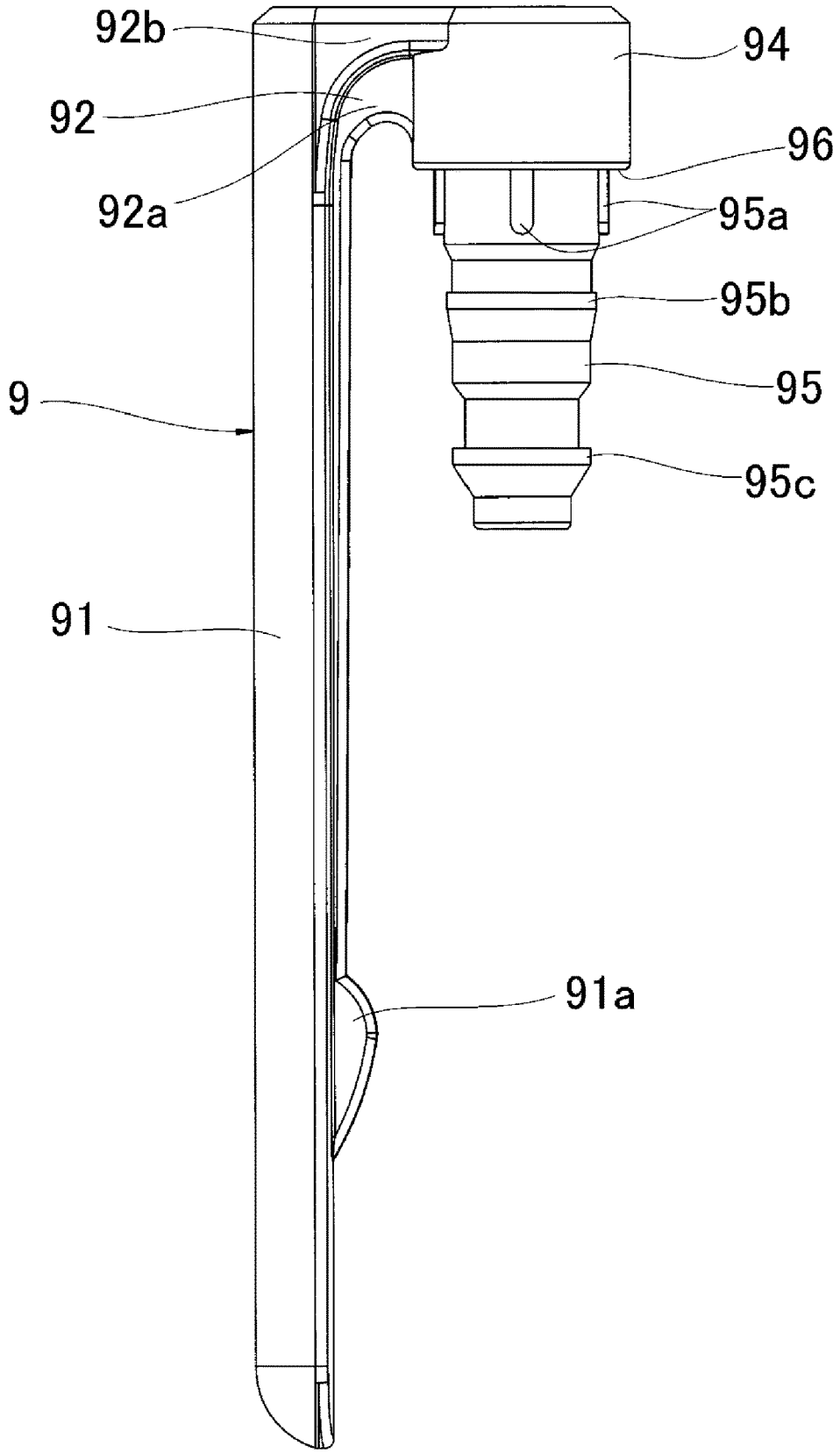
FIG. 20 is a side view of a push member in a third embodiment of the present invention.
Figure 21:
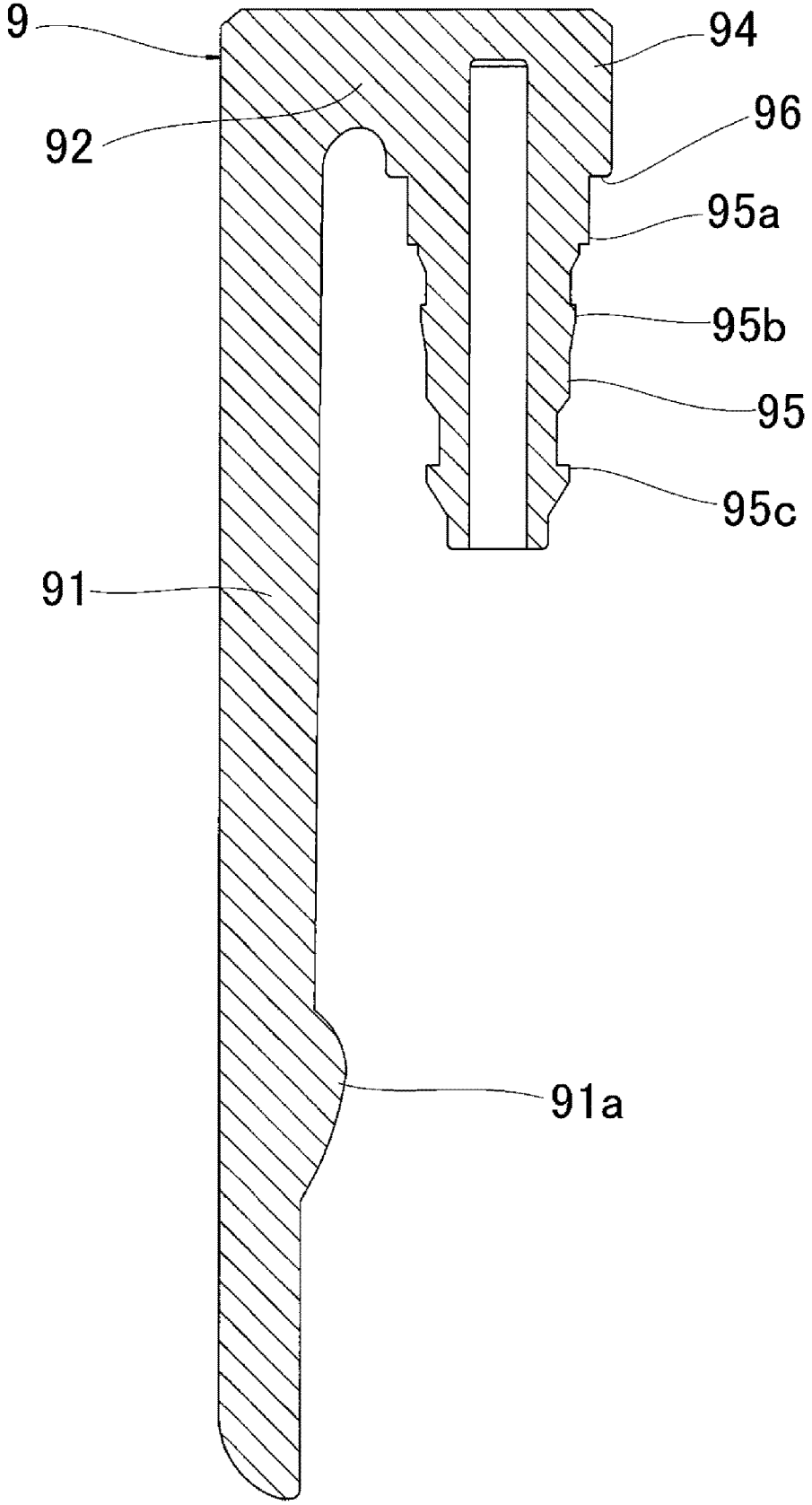
FIG. 21 is a longitudinal sectional view of the push member in the third embodiment of the present invention.
Figure 22:
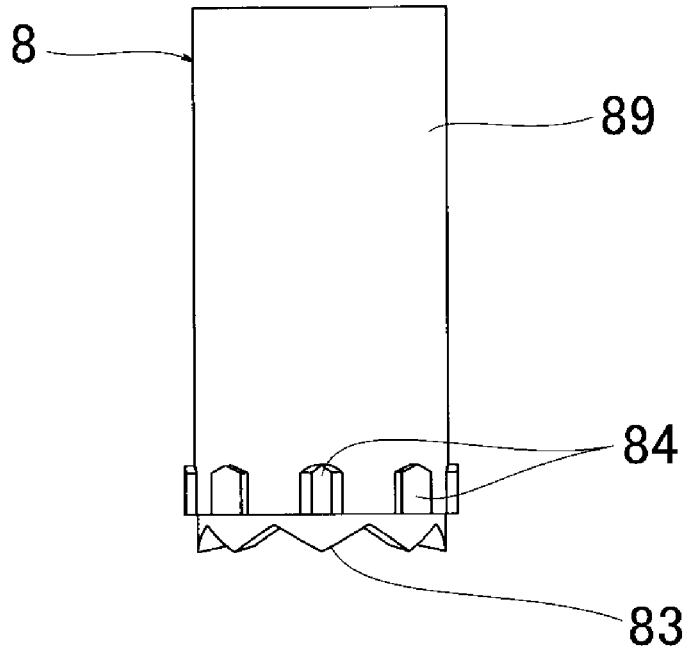
FIG. 22 is a front view of a cam member in the third embodiment of the present invention.
Figure 23:
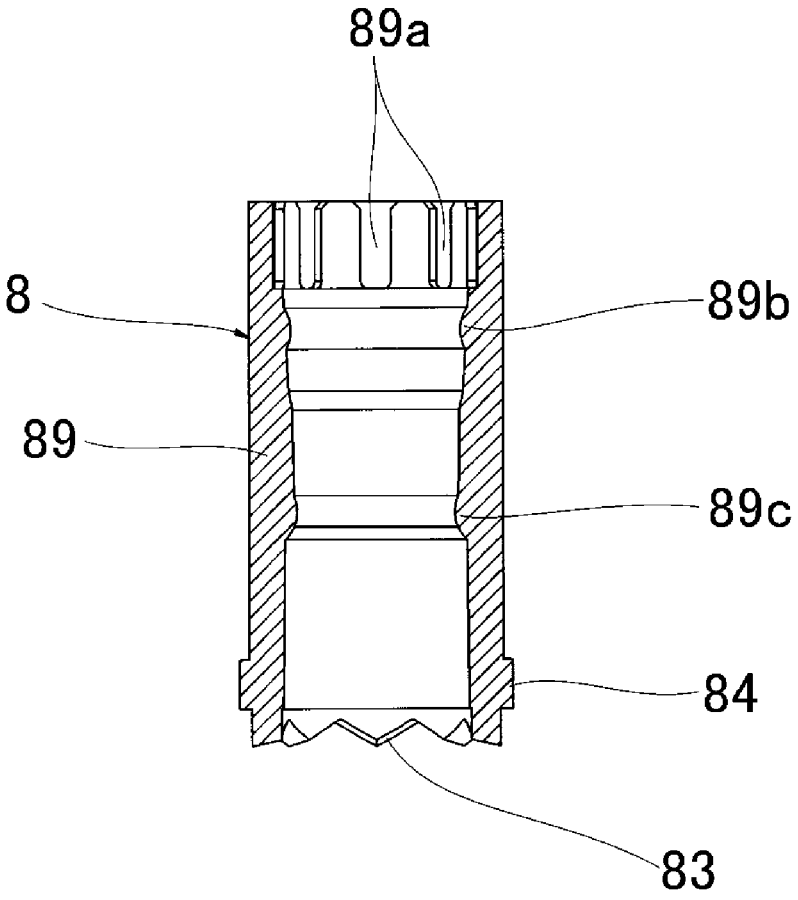
FIG. 23 is a longitudinal sectional view of the cam member in the third embodiment of the present invention.
Figure 24:
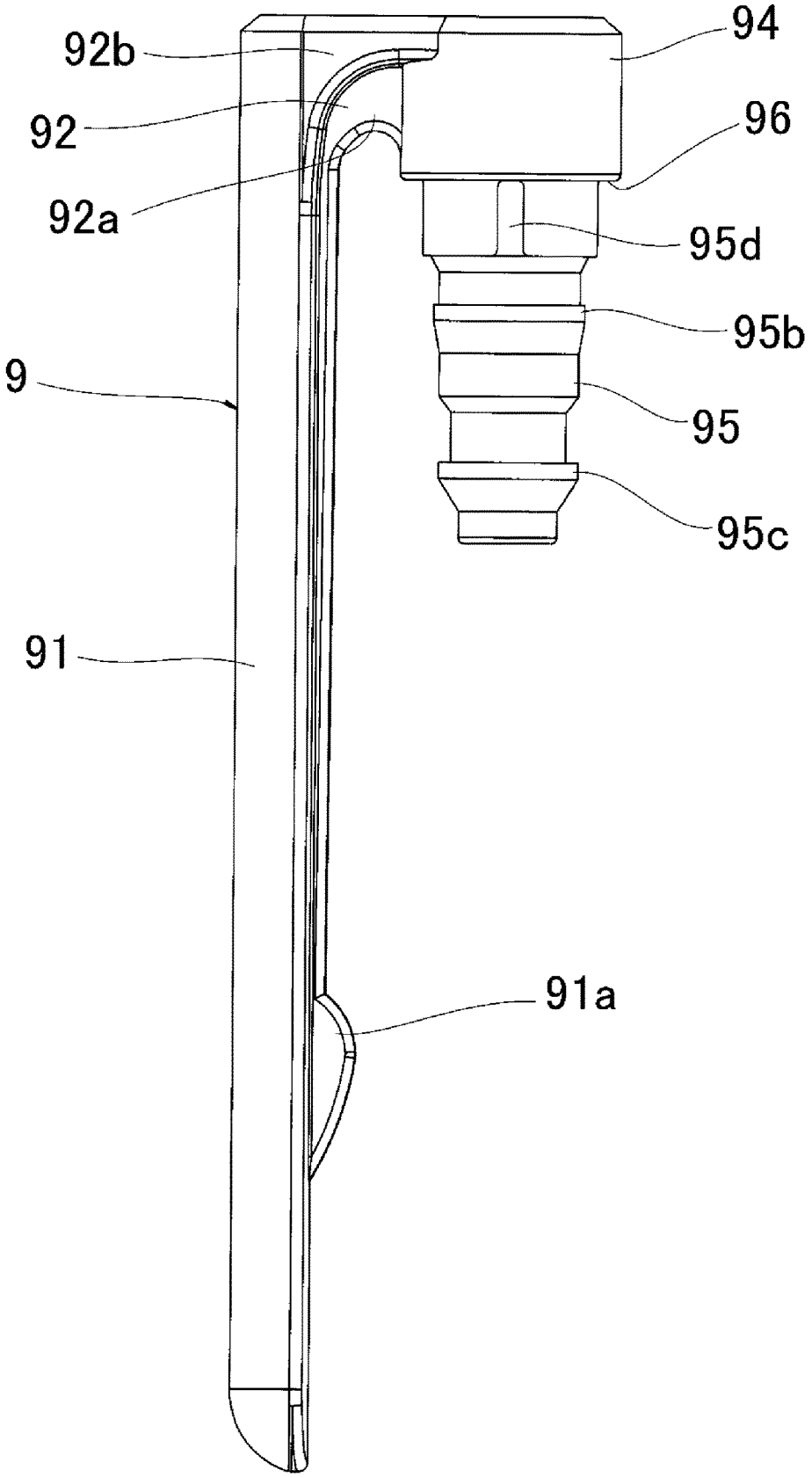
FIG. 24 is a side view of a push member in a fourth embodiment of the present invention.
Figure 25:
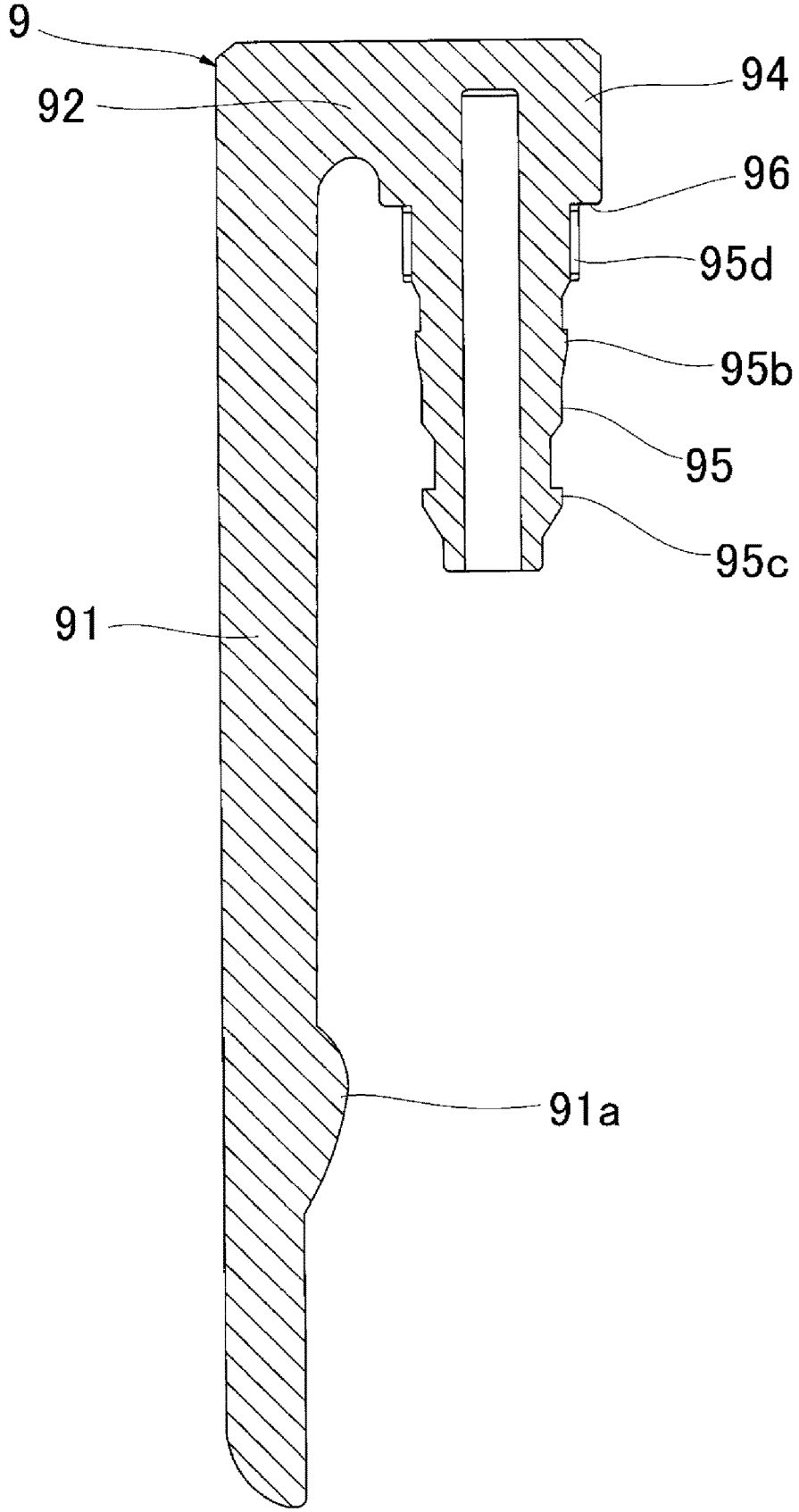
FIG. 25 is a longitudinal sectional view of the push member in the fourth embodiment of the present invention.
Figure 26:
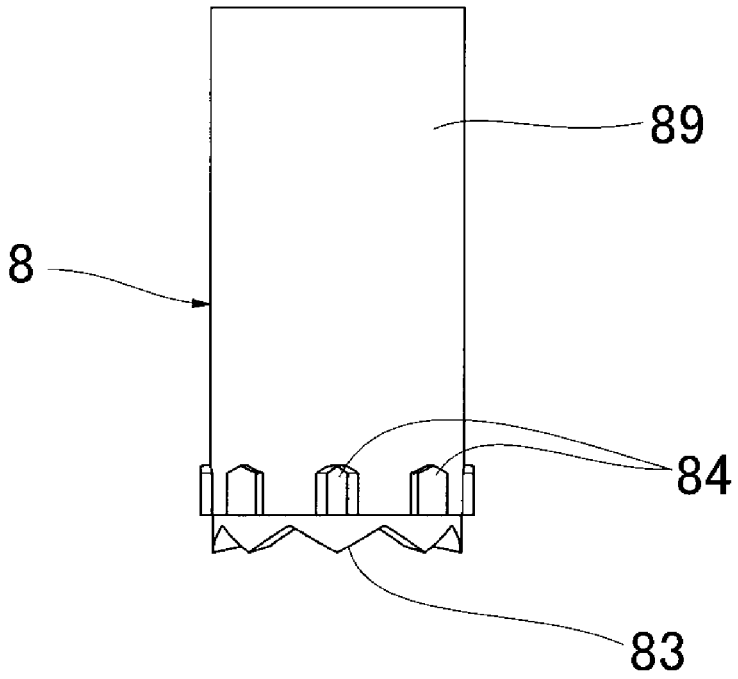
FIG. 26 is a front view of a cam member in the fourth embodiment of the present invention.
Figure 27:
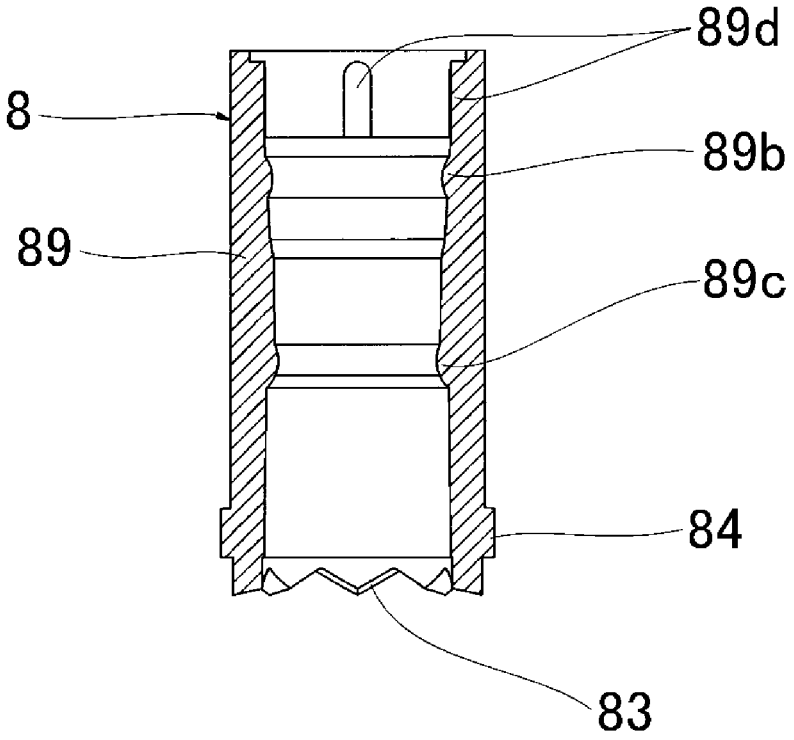
FIG. 27 is a longitudinal sectional view of the cam member in the fourth embodiment of the present invention.
Figure 28:
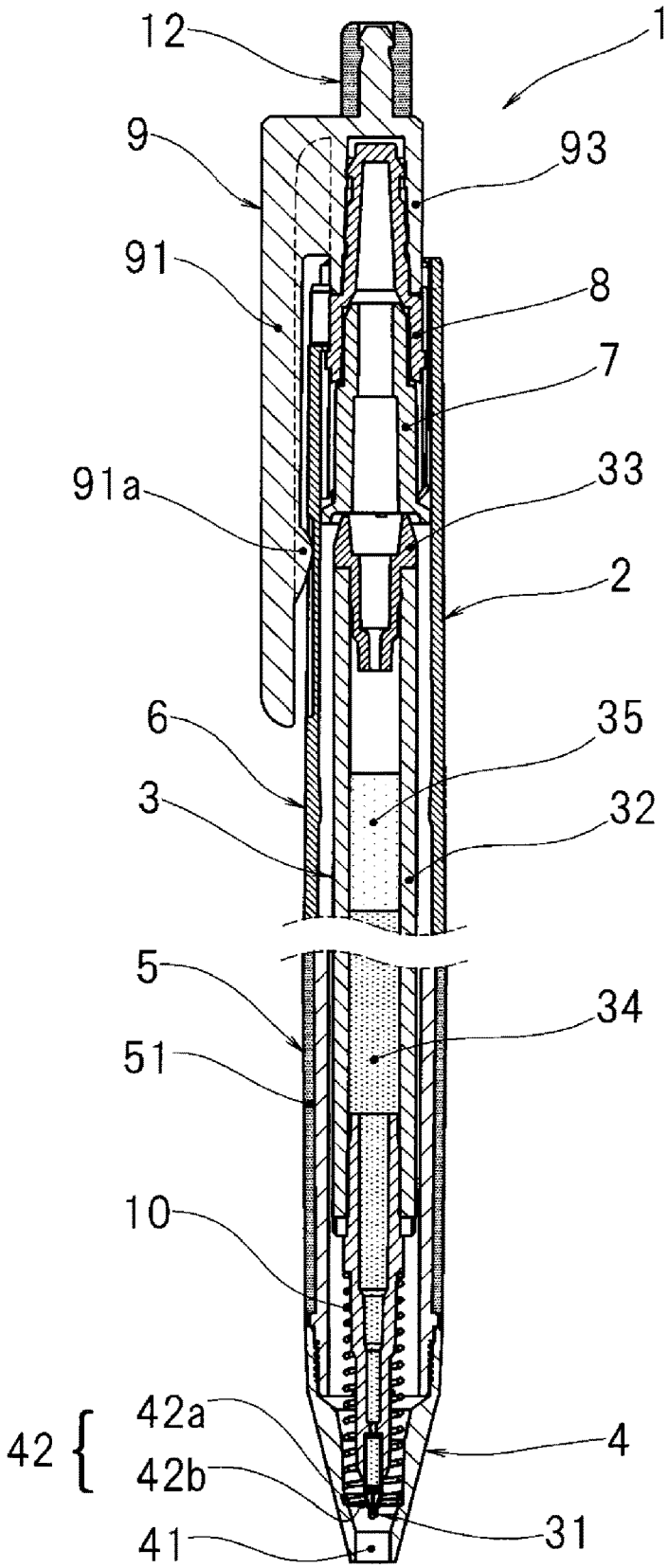
FIG. 28 is a longitudinal sectional view illustrating a pen point retracting state in a fifth embodiment of the present invention.
Figure 29:
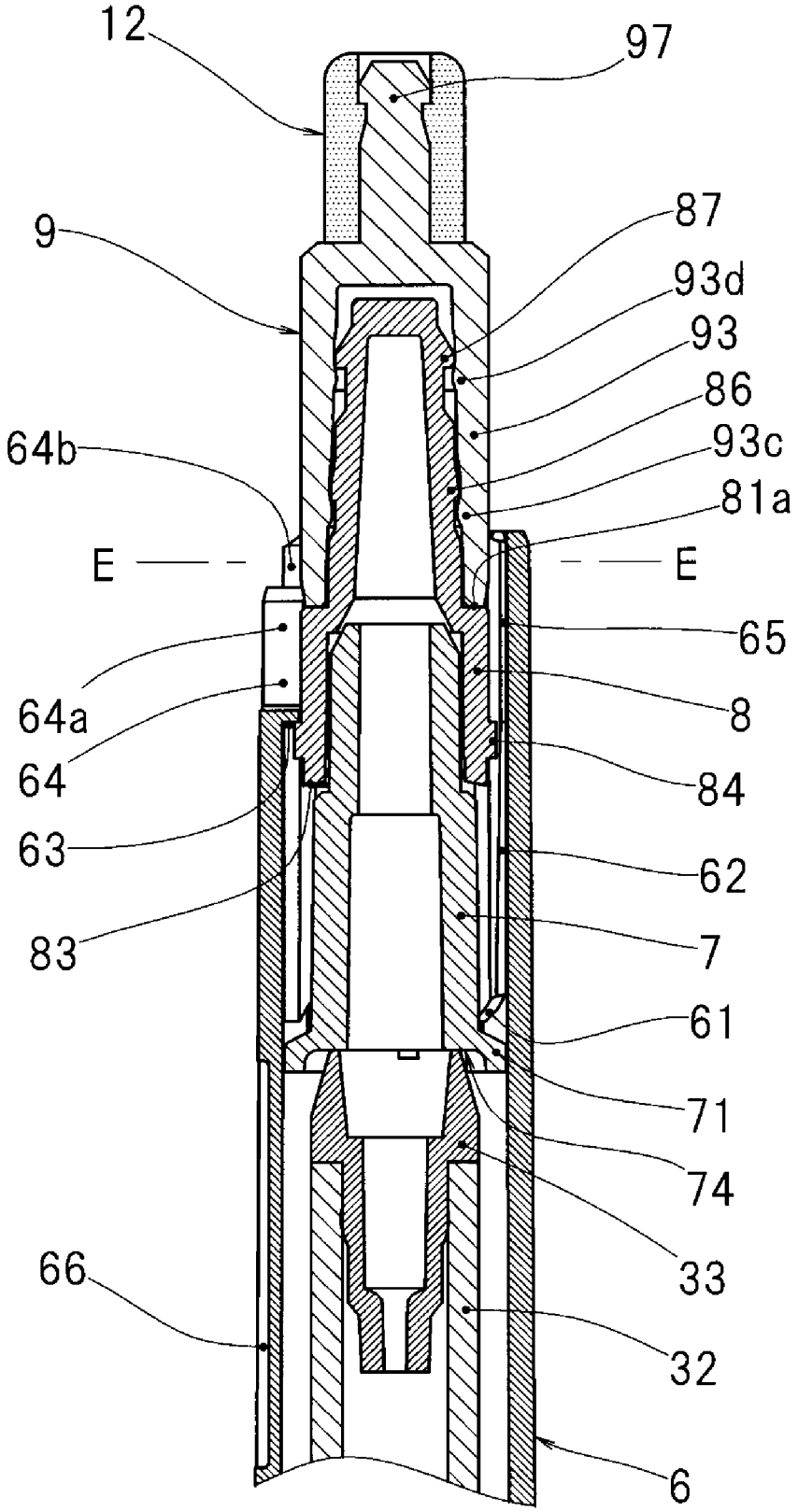
FIG. 29 is an enlarged longitudinal sectional view of a main part in the fifth embodiment of the present invention and illustrates a state in which a guide projection and a guide groove are disengaged from each other.
Figure 30:
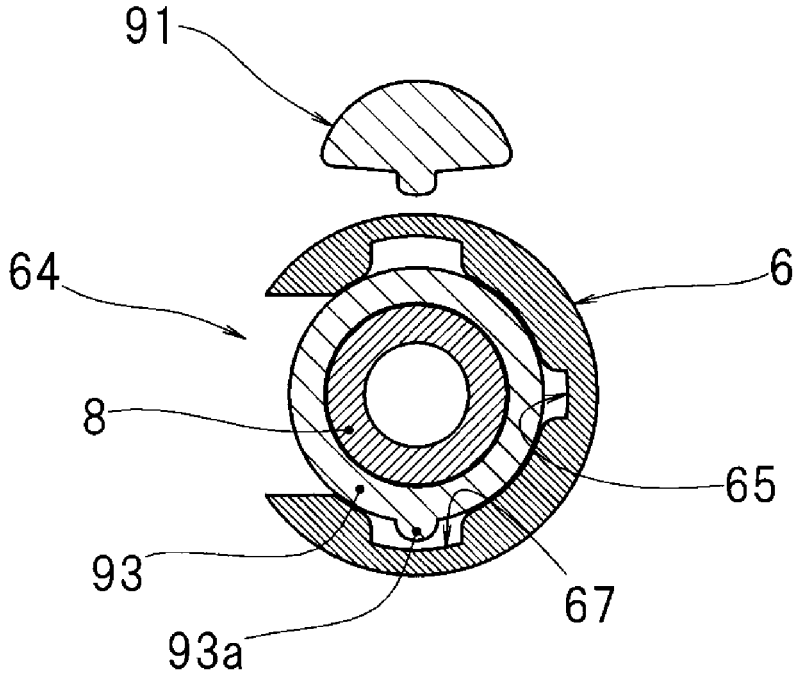
FIG. 30 is a sectional view taken along line E-E in FIG. 29.
Figure 31:
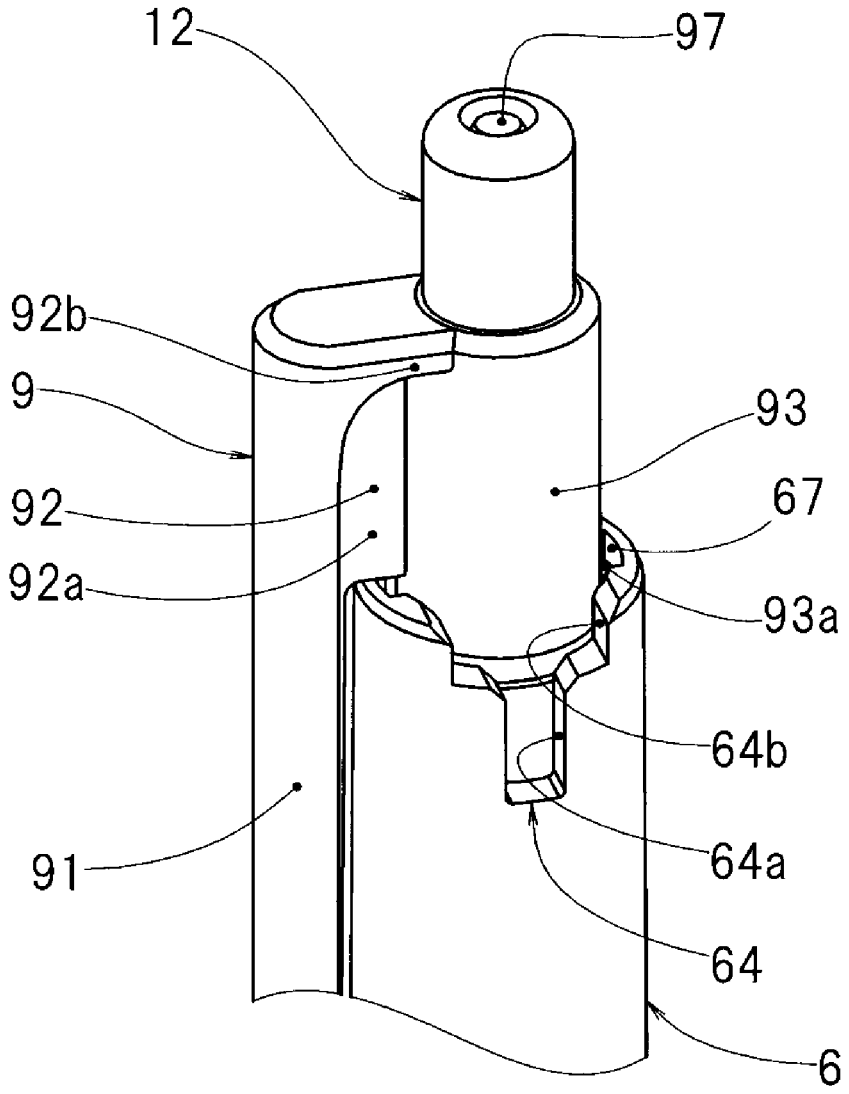
FIG. 31 is a perspective view of a main part in FIG. 29.
Figure 32:
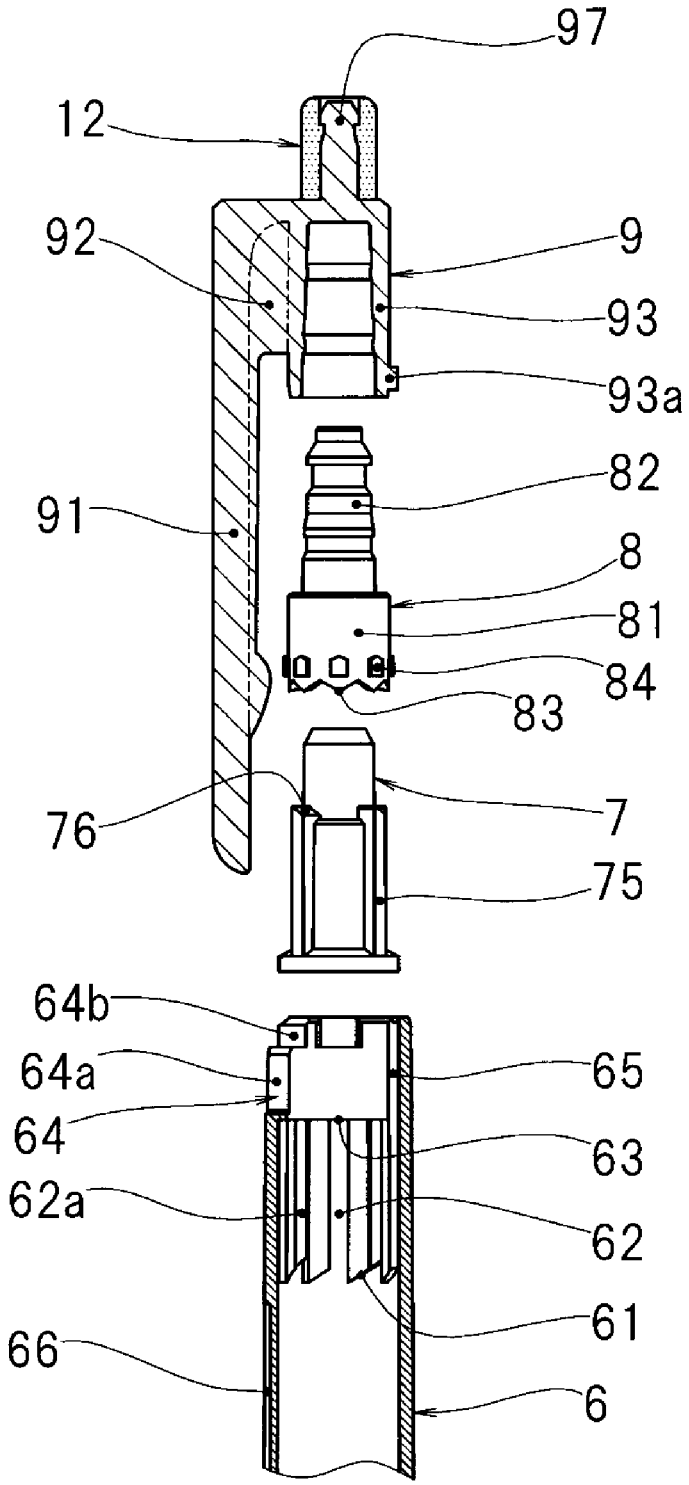
FIG. 32 is an exploded view illustrating main components of a protruding and retracting mechanism in the fifth embodiment of the present invention.

The small-diameter rear portion 82 (insertion portion) of the cam member 8 is inserted into the tubular portion 93. The outer face of the small-diameter rear portion 82 is connected by fitting to the inner face of the tubular portion 93. In the state in which the outer face of the small-diameter rear portion 82 is fitted to the inner face of the tubular portion 93, (a) the projecting portions 85 on the outer face of the small-diameter rear portion 82 are engaged with the recessed portions 93*b* in the inner face of the tubular portion 93, (b) the first outward projection 86 on the outer face of the small-diameter rear portion 82 is locked by climbing over the first inward projection 93*c* on the inner face of the tubular portion 93, and (c) the second outward projection 87 on the outer face of the small-diameter rear portion 82 is locked by climbing over the second inward projection 93*d* on the inner face of the tubular portion 93. In addition, an abutment step portion 81*a* is formed on a rear end of the large-diameter front portion 81, and the front end of the tubular portion 93 abuts against the abutment step portion 81*a*. The recessed portions 93*b* and the projecting portions 85 are brought into detent engagement with each other with play in the rotation direction. An amount of play between the cam grooves 62 and the engagement projections 84 in the rotation direction is set to be larger than an amount of play between the recessed portions 93*b* and the projecting portions 85 in the rotation direction. As illustrated in FIG. 15, specifically, a widthwise size T1 of each recessed portion 93*b* in the inner face of the tubular portion 93 is different from a widthwise size T2 of each projecting portion 85 on the outer face of the small-diameter rear portion 82 by 0.10 mm. Preferably, this amount of play (T1-T2) is set within a range from 0.01 to 0.15 mm. More preferably, this amount of play (T1-T2) is set within a range from 0.01 to 0.12 mm. In the present embodiment, in other words, the amount of play between the cam grooves 62 and the engagement projections 84 in the rotation direction is set to be larger than the amount of play between the recessed portions 93*b* and the projecting portions 85 in the rotation direction. However, the amount of play (0.10 mm) is illustrative, and any other value may be employed for this the amount of play as long as the amount of play between the cam grooves 62 and the engagement projections 84 in the rotation direction is set to be larger than the amount of play between the recessed portions 93*b* and the projecting portions 85 in the rotation direction.

The guide projection 93*a* of the push member 9 is engaged with the guide groove 65 in the inner face of the rear-end opening of the rear barrel 6 and one of the cam grooves 62 communicating with the guide groove 65 in the longitudinal direction, so as to be movable in the longitudinal direction. The guide projection 93*a* is engaged with the guide groove 65 in the pen point retracting state, and is engaged with one of the cam grooves 62 in the pen point protruding state.

Pen Point Protruding and Retracting Action

In the pen point retracting state, the engagement projections 84 of the cam member 8 are locked at the locking wall portion 63 on the rear ends of the cam grooves 62, the protuberances 75 of the rotary member 7 are engaged with the cam grooves 62, and the cam slopes 76 on the rear ends of the protuberances 75 in the rotary member 7 are in abutment with the cam projections 83. The resilient element 10 always biases the writing element 3 rearward.

In the pen point retracting state, when the push member 9 is pressed frontward against the rearward biasing force of the resilient element 10, the protuberances 75 and the engagement projections 84 move frontward along the cam grooves 62, so that the protuberances 75 are disengaged from the cam grooves 62 in the frontward direction. At the same time, the rotary member 7 is rotated by the contact of the cam slopes 76 with the cam projections 83, and the cam slopes 76 on the rear ends of the protuberances 75 are engaged with the cam teeth 61, so that the pen point protruding state is maintained.

In the pen point protruding state, when the push member 9 is pressed frontward against the rearward biasing force of the resilient element 10, the protuberances 75 and the engagement projections 84 move frontward, and the rotary member 7 is rotated by the contact of the cam slopes 76 with the cam projections 83, so that the cam slopes 76 on the rear ends of the protuberances 75 are disengaged from the cam teeth 61. Thereafter, when the frontward press on the push member 9 is canceled, the rearward biasing force of the resilient element 10 causes the rotary member 7 and the cam member 8 to move rearward. The protuberances 75 are thus engaged with the cam grooves 62 and moved rearward along the cam grooves 62. Thereafter, the engagement projections 84 of the cam member 8 are locked at the locking wall portion 63 on the rear ends of the cam grooves 62. The pen point retracting state is thus established.

In the present embodiment, the writing element 3 is exchangeable since the middle barrel 5 is screwed into the front barrel 4 in the detachable manner. The writing element 3 is also exchangeable since the middle barrel 5 is screwed into the rear barrel 6 in the detachable manner.

The retractable writing instrument 1 according to the present embodiment comprises: the barrel 2; the writing element 3 that is accommodated in the barrel 2 and is movable in the longitudinal direction; the push member 9 that includes the clip 91 and is disposed on the rear end portion of the barrel 2; and the protruding and retracting mechanism that causes the pen point 31 of the writing element 3 to protrude from and retract into the front end of the barrel 2 at the frontward press on the push member 9. The protruding and retracting mechanism includes: the plurality of cam teeth 61 and plurality of cam grooves 62 that are formed on and in the inner face of the barrel 2, are arranged alternately along the circumferential direction, and extend in the longitudinal direction; the rotary member 7 that is rotatably disposed rearward of the writing element 3 and includes the plurality of protuberances 75 engageable alternately with the cam teeth 61 or the cam grooves 62; the cam member 8 that is connected to the push member 9 and includes the plurality of cam projections 83 rotating the rotary member 7, and the plurality of engagement projections 84 engaged with the cam grooves 62 in the inner face of the barrel 2 so as to be movable in the longitudinal direction; and the resilient element 10 that biases the writing element 3 rearward. The push member 9 and the cam member 8 are in detent engagement with each other. Therefore, the engagement projections 84 of the cam member 8 are always engaged with the cam grooves 62 in the inner face of the barrel 2, and the push member 9 and the cam member 8 are always in detent engagement with each other. This configuration reliably prevents the push member 9 including the clip 91 from rotating with respect to the barrel 2 even in the pen point retracting state.

In the retractable writing instrument according to the present embodiment, the push member 9 includes the tubular portion 93 inserted into the rear-end opening of the barrel 2, the cam member 8 includes the insertion portion 82 inserted into the tubular portion 93, and the inner wall of the tubular portion 93 and the outer wall of the insertion portion 82 are in detent engagement with each other. This configuration achieves a structure to reliably prevent the mutual rotation between the push member 9 and the cam member 8.

In the retractable writing instrument 1 according to the present embodiment, the plurality of recessed portions 93*b* extending in the longitudinal direction are formed in the inner face of the tubular portion 93, the plurality of projecting portions 85 engageable with the recessed portions 93*b* are formed on the outer face of the insertion portion 82, and the push member 9 and the cam member 8 are in detent engagement with each other by the engagement of the recessed portions 93*b* with the projecting portions 85. This configuration achieves a structure to more reliably prevent the mutual rotation between the push member 9 and the cam member 8.

In the retractable writing instrument 1 according to the present embodiment, the amount of play between the cam grooves 62 and the engagement projections 84 in the rotation direction is set to be larger than the amount of play between the recessed portions 93*b* and the projecting portions 85 in the rotation direction. Therefore, even when a positional deviation in the rotation direction occurs at engagement of the recessed portions 93*b* in the inner face of the push member 9 with the projecting portions 85 on the outer face of the cam member 8, the cam grooves 62 in the inner face of the barrel 2 are appropriately engaged with the engagement projections 84 on the outer face of the cam member 8. This configuration thus reduces occurrence of sliding failure at the cam grooves 62 and the engagement projections 84.

In the retractable writing instrument 1 according to the present embodiment, the locking wall portion 63 at which the engagement projections 84 are locked in the longitudinal direction in the pen point retracting state are formed on the rear ends of the cam grooves 62, the guide groove 65 communicating with one of the cam grooves 62 and extending in the longitudinal direction is formed in the inner face of the barrel 2 and is located rearward of the cam grooves 62, the guide projection 93*a* is formed on the outer face of the tubular portion 93 in the push member 9, the guide projection 93*a* is engaged with the guide groove 65 in the pen point retracting state, and the guide projection 93*a* is engaged with one of the cam grooves 62 in the pen point protruding state. This configuration further prevents the rotation of the push member 9, by the engagement of the guide groove 65 with the guide projection 93*a* in the pen point retracting state. Also in the retractable writing instrument 1 according to the present embodiment, this configuration eliminates a necessity to form a guide groove 65 having a length corresponding to the push stroke of the push member 9 and allows the lengthwise size of the barrel 2 located rearward of the cam grooves 62 to be set shorter, which results in an increase of the degree of freedom about design of the push member 9 and barrel 2.

In the retractable writing instrument 1 according to the present embodiment, the push member 9 includes: the clip 91; the clip base portion 92 that is formed integrally and continuously with the rear portion of the clip 91; and the tubular portion 93 that is formed integrally and continuously with the clip base portion 92, the slide hole 64 extending in the longitudinal direction is formed in the sidewall of the rear end portion of the barrel 2 and is opened rearward at the rear end of the barrel 2, the front end portion of the clip base portion 92 is inserted into the slide hole 64 in the pen point protruding state, and the front end portion of the clip base portion 92 is located rearward of the slide hole 64 in the pen point retracting state. As compared with a configuration provided with no slide hole, this configuration thus achieves the adequate length of the clip base portion 92 in the lengthwise direction and improves the durability of the clip 91.

<Second Embodiment>

A retractable writing instrument according to a second embodiment of the present invention will be described with reference to the drawings (see FIGS. 16 to 19).

The present embodiment is a partial modification of the first embodiment. Specifically, the projecting portions 85 of the cam member 8 in the first embodiment are changed to recessed portions 88, and the recessed portions 93*b* of the push member 9 in the first embodiment are changed to projecting portions 93*e*.

Cam Member

A cam member 8 is a one-end closed cylindrical body made of synthetic resin. In other words, the cam member 8 has a front end that is opened and a rear end that is closed. The cam member 8 has a large-diameter front portion 81 and a small-diameter rear portion 82 (insertion portion) smaller in outer diameter than the front portion 81. The rear portion 82 is formed integrally and continuously with the front portion 81 and is located rearward of the front portion 81. The cam member 8 also has a plurality (e.g., eight) of cam projections 83. The cam projections 83 are formed on a front end face of the cam member 8 (a front end face of the large-diameter front portion 81). The cam projections 83 are also formed circumferentially and continuously in a saw-tooth shape (a chevron shape). The cam member 8 also has a plurality (e.g., eight) of engagement projections 84. The engagement projections 84 are formed on an outer face of a front end portion of the cam member 8 (an outer face of a front end portion of the large-diameter front portion 81). The engagement projections 84 are also formed discretely along a circumferential direction. The engagement projections 84 are respectively located rearward of the cam projections 83. In a pen point retracting state, the engagement projections 84 are locked at a locking wall portion 63 in a longitudinal direction. The engagement projections 84 are engaged with cam grooves 62 with an amount of play in a rotation direction. The engagement projections 84 are also engaged with cam guide grooves 62*a* with an amount of play in the rotation direction. Specifically, a widthwise size of each cam groove 62 is different from a widthwise size of each engagement projection 84 by 0.19 mm. Likewise, the widthwise size of each engagement projection 84 is different from a widthwise size of each cam guide groove 62*a* by 0.19 mm. Preferably, this amount of play is set within a range from 0.16 to 0.25 mm. More preferably, this amount of play is set within a range from 0.18 to 0.21 mm. However, these values are illustrative, and this amount of play is not limited to thereto.

The cam member 8 also has a plurality (e.g., four) of recessed portions 88 extending in the longitudinal direction. The recessed portions 88 are formed in an outer face of a front end portion (an outer face of a base portion) of the small-diameter rear portion 82 (insertion portion) in the cam member 8. The recessed portions 88 are spaced evenly along the circumferential direction. The cam member 8 also has a first outward projection 86. The first outward projection 86 is formed on an outer face of the small-diameter rear portion 82 (insertion portion) and is located rearward of the recessed portions 88. The cam member 8 also has a second outward projection 87. The second outward projection 87 is formed on the outer face of the small-diameter rear portion 82 (insertion portion) and is located rearward of the first outward projection 86. Each of the first outward projection 86 and the second outward projection 87 is constituted of an annular projection or a plurality of discrete projections. The first outward projection 86 is set to be larger in outer diameter than the second outward projection 87. The small-diameter rear portion 82 (insertion portion) is thus smoothly and easily inserted into a tubular portion 93.

Push Member

A push member 9 includes a clip 91, a clip base portion 92 and the one-end closed tubular portion 93, and is made of synthetic resin. The clip 91 extends in the longitudinal direction. The clip base portion 92 is formed integrally and continuously with a rear portion of the clip 91. The tubular portion 93 is formed integrally and continuously with the clip base portion 92. A projected bump 91*a* is formed integrally with an inner face of the clip 91 so as to protrude from the inner face of the clip 91. The clip base portion 92 includes a plate-shaped first connection wall portion 92*a* and a plate-shaped second connection wall portion 92*b*. The first connection wall portion 92*a* extends in the longitudinal direction. The second connection wall portion 92*b* is formed integrally and continuously with a rear end of the first connection wall portion 92*a* and extends in a direction perpendicular to an axis. This configuration improves the durability of the clip base portion 92. The projected bump 91*a* of the clip 91 is formed on a plate shape extending in the longitudinal direction, and is engaged with a slide groove 66 in an outer face of a rear barrel 6 so as to be movable in the longitudinal direction. This configuration prevents rotation of the clip 91.

The clip base portion 92 is insertable into a slide hole 64. When the push member 9 is pressed frontward in transition from the pen point retracting state to a pen point protruding state, the first connection wall portion 92*a* is inserted into a narrower front-side hole 64*a* of the slide hole 64, and the second connection wall portion 92*b* is inserted into a wider rear-side hole 64*b* of the slide hole 64. This configuration further prevents rotation of the clip 91 at the time when the push member 9 is pressed frontward.

The push member 9 has one guide projection 93*a*. The guide projection 93*a* is formed integrally with an outer face of the tubular portion 93 and is located opposite the clip base portion 92 in a radial direction. The push member 9 also has a plurality (e.g., eight) of projecting portions 93*e* extending in the longitudinal direction. The projecting portions 93*e* are formed on an inner face of a front-end opening of the tubular portion 93. The projecting portions 93*e* are spaced evenly along the circumferential direction. The push member 9 also has a first inward projection 93*c*. The first inward projection 93*c* is formed on an inner face of the tubular portion 93 and is located rearward of the projecting portions 93*e*. The push member 9 also has a second inward projection 93*d*. The second inward projection 93*d* is formed on the inner face of the tubular portion 93 and is located rearward of the first inward projection 93*c*. Each of the first inward projection 93*c* and the second inward projection 93*d* is constituted of an annular projection or a plurality of discrete projections. The first inward projection 93*c* is set to be larger in inner diameter than the second inward projection 93*d*. The small-diameter rear portion 82 (insertion portion) is thus smoothly and easily inserted into the tubular portion 93. The clip 91, the clip base portion 92 (the second connection wall portion 92*b*) and the tubular portion 93 respectively have rear end faces that are flush with one another and are defined as a press operation face (push face).

The small-diameter rear portion 82 (insertion portion) of the cam member 8 is inserted into the tubular portion 93. The outer face of the small-diameter rear portion 82 is connected by fitting to the inner face of the tubular portion 93. In the state in which the outer face of the small-diameter rear portion 82 is fitted to the inner face of the tubular portion 93, (a) the recessed portions 88 in the outer face of the small-diameter rear portion 82 are engaged with the projecting portions 93*e* on the inner face of the tubular portion 93, (b) the first outward projection 86 on the outer face of the small-diameter rear portion 82 is locked by climbing over the first inward projection 93*c* on the inner face of the tubular portion 93, and (c) the second outward projection 87 on the outer face of the small-diameter rear portion 82 is locked by climbing over the second inward projection 93*d* on the inner face of the tubular portion 93. The projecting portions 93*e* and the recessed portions 88 are brought into detent engagement with each other with play in the rotation direction. In addition, an abutment step portion 81*a* is formed on a rear end of the large-diameter front portion 81, and the front end of the tubular portion 93 abuts against the abutment step portion 81*a*. An amount of play between the cam grooves 62 and the engagement projections 84 in the rotation direction is set to be larger than an amount of play between the projecting portions 93*e* and the recessed portions 88 in the rotation direction. Specifically, a widthwise size of each projecting portion 93*e* on the inner face of the tubular portion 93 is different from a widthwise size of each recessed portion 88 in the outer face of the small-diameter rear portion 82 by 0.10 mm. Preferably, this amount of play is set within a range from 0.01 to 0.15 mm. More preferably, this amount of play is set within a range from 0.01 to 0.12 mm. However, these values are illustrative, and this amount of play is not limited to thereto. In the present embodiment, in other words, the amount of play between the cam grooves 62 and the engagement projections 84 in the rotation direction is set to be larger than the amount of play between the projecting portions 93*e* and the recessed portions 88 in the rotation direction.

Other configurations, operations and effects are the same as those in the first embodiment; therefore, the description thereof will not be given here.

<Third Embodiment>

A retractable writing instrument according to a third embodiment of the present invention will be described with reference to the drawings (see FIGS. 20 to 24).

The present embodiment is a partial modification of the first embodiment. Specifically, the insertion portion 82 of the cam member 8 in the first embodiment is changed to a tubular portion 89, and the tubular portion 93 of the push member 9 in the first embodiment is changed to an insertion portion 95.

Cam Member

A cam member 8 is a cylindrical body made of synthetic resin and having both ends opened. The cam member 8 includes a tubular portion 89. The cam member 8 also has a plurality (e.g., eight) of cam projections 83. The cam projections 83 are formed on a front end face of the cam member 8. The cam projections 83 are formed circumferentially and continuously in a sawtooth shape (a chevron shape). The cam member 8 also has a plurality (e.g., eight) of engagement projections 84. The engagement projections 84 are formed on an outer face of a front end portion of the cam member 8. The engagement projections 84 are also formed discretely along a circumferential direction. The engagement projections 84 are respectively located rearward of the cam projections 83. In a pen point retracting state, the engagement projections 84 are locked at a locking wall portion 63 in a longitudinal direction. The engagement projections 84 are engaged with cam grooves 62 with an amount of play in a rotation direction. The engagement projections 84 are also engaged with cam guide grooves 62*a* with an amount of play in the rotation direction. Specifically, a widthwise size of each cam groove 62 is different from a widthwise size of each engagement projection 84 by 0.19 mm. Likewise, the widthwise size of each engagement projection 84 is different from a widthwise size of each cam guide groove 62*a* by 0.19 mm. Preferably, this amount of play is set within a range from 0.16 to 0.25 mm. More preferably, this amount of play is set within a range from 0.18 to 0.21 mm. However, these values are illustrative, and this amount of play is not limited to thereto.

The cam member 8 also has a plurality (e.g., eight) of recessed portions 89*a* extending in the longitudinal direction. The recessed portions 89*a* are formed in an inner face of a rear-end opening of a tubular portion 89 in the cam member 8. The recessed portions 89*a* are spaced evenly along the circumferential direction. Each of the recessed portions 89*a* is opened rearward at a rear end of the tubular portion 89. The cam member 8 also has a first inward projection 89*b*. The first inward projection 89*b* is formed on an inner face of the tubular portion 89 and is located frontward of the recessed portions 89*a*. The cam member 8 also has a second inward projection 89*c*. The second inward projection 89*c* is formed on the inner face of the tubular portion 89 and is located frontward of the first inward projection 89*b*. Each of the first inward projection 89*b* and the second inward projection 89*c* is constituted of an annular projection or a plurality of discrete projections. The first inward projection 89*b* is set to be larger in inner diameter than the second inward projection 89*c*. An insertion portion 95 is thus smoothly and easily inserted into the tubular portion 89.

Push Member

A push member 9 includes a clip 91, a clip base portion 92, a shaft portion 94 and the insertion portion 95, and is made of synthetic resin. The clip 91 extends in the longitudinal direction. The clip base portion 92 is formed integrally and continuously with a rear portion of the clip 91. The shaft portion 94 is formed integrally and continuously with the clip base portion 92 and is formed in a cylindrical shape or a columnar shape. The insertion portion 95 is formed integrally and continuously with the shaft portion 94 and is located frontward of the shaft portion 94. The insertion portion 95 is also formed in a cylindrical shape or a columnar shape. A projected bump 91*a* is formed integrally with an inner face of the clip 91 so as to protrude from the inner face of the clip 91. The clip base portion 92 includes a plate-shaped first connection wall portion 92*a* and a plate-shaped second connection wall portion 92*b*. The first connection wall portion 92*a* extends in the longitudinal direction. The second connection wall portion 92*b* is formed integrally and continuously with a rear end of the first connection wall portion 92*a* and extends in a direction perpendicular to an axis. This configuration improves the durability of the clip base portion 92. The projected bump 91*a* of the clip 91 is formed on a plate shape extending in the longitudinal direction, and is engaged with a slide groove 66 in an outer face of a rear barrel 6 so as to be movable in the longitudinal direction. This configuration prevents rotation of the clip 91.

The clip base portion 92 is insertable into a slide hole 64. When the push member 9 is pressed frontward in transition from a pen point retracting state to a pen point protruding state, the first connection wall portion 92*a* is inserted into a narrower front-side hole 64*a* of the slide hole 64, and the second connection wall portion 92*b* is inserted into a wider rear-side hole 64*b* of the slide hole 64. This configuration further prevents rotation of the clip 91 at the time when the push member 9 is pressed frontward.

The insertion portion 95 has a small-diameter front portion, and a large-diameter rear portion that is larger in outer diameter than the small-diameter front portion. The push member 9 has a plurality (e.g., eight) of projecting portions 95*a* extending in the longitudinal direction. The projecting portions 95*a* are formed on an outer face of the large-diameter rear portion, and are spaced evenly along the circumferential direction. The push member 9 also has a first outward projection 95*b*. The first outward projection 95*b* is formed on an outer face of the insertion portion 95 (an outer face of the small-diameter front portion) and is located frontward of the projecting portions 95*a*. The push member 9 also has a second outward projection 95*c*. The second outward projection 95*c* is formed on the outer face of the insertion portion 95 (the outer face of the small-diameter front portion) and is located frontward of the first outward projection 95*b*. Each of the first outward projection 95*b* and the second outward projection 95*c* is constituted of an annular projection or a plurality of discrete projections. The first outward projection 95*b* is set to be larger in outer diameter than the second outward projection 95*c*. The insertion portion 95 is thus smoothly and easily inserted into the tubular portion 89. The clip 91, the clip base portion 92 (the second connection wall portion 92*b*) and the shaft portion 94 respectively have rear end faces that are flush with one another and are defined as a press operation face (push face).

The insertion portion 95 of the push member 9 is inserted into the tubular portion 89 of the cam member 8. The outer face of the insertion portion 95 is connected by fitting to the inner face of the tubular portion 89. In the state in which the outer face of the insertion portion 95 is fitted to the inner face of the tubular portion 89, (a) the projecting portions 95*a* on the outer face of the insertion portion 95 are engaged with the recessed portions 89*a* in the inner face of the tubular portion 89, (b) the first outward projection 95*b* on the outer face of the insertion portion 95 is locked by climbing over the first inward projection 89*b* on the inner face of the tubular portion 89, and (c) the second outward projection 95*c* on the outer face of the insertion portion 95 is locked by climbing over the second inward projection 89*c* on the inner face of the tubular portion 89. The recessed portions 89*a* and the projecting portions 95*a* are brought into detent engagement with each other with play in the rotation direction. An amount of play between the cam grooves 62 and the engagement projections 84 in the rotation direction is set to be larger than an amount of play between the recessed portions

89*a* and the projecting portions 95*a* in the rotation direction. Specifically, a widthwise size of each recessed portion 89*a* is different from a widthwise size of each projecting portion 95*a* by 0.10 mm. Preferably, this amount of play is set within a range from 0.01 to 0.15 mm. More preferably, this amount of play is set within a range from 0.01 to 0.12 mm. However, these values are illustrative, and this amount of play is not limited to thereto. In the present embodiment, in other words, the amount of play between the cam grooves 62 and the engagement projections 84 in the rotation direction is set to be larger than the amount of play between the recessed portions 89*a* and the projecting portions 95*a* in the rotation direction.

An abutment step portion 96 is formed between the shaft portion 94 and the insertion portion 95. When the outer face of the insertion portion 95 is connected to the inner face of the tubular portion 89, the rear end of the cam member 8 abuts against the abutment step portion 96.

Other configurations, operations and effects are the same as those in the first embodiment; therefore, the description thereof will not be given here.

<Fourth Embodiment>

A retractable writing instrument according to a fourth embodiment of the present invention will be described with reference to the drawings (see FIGS. 24 to 27).

The present embodiment is a partial modification of the first embodiment. Specifically, the insertion portion 82 of the cam member 8 in the first embodiment is changed to a tubular portion 89, and the tubular portion 93 of the push member 89 in the first embodiment is changed to an insertion portion 95. The present embodiment is also a partial modification of the third embodiment. Specifically, the projecting portions 95*a* of the push member 9 in the third embodiment are changed to recessed portions 95*d*, and the recessed portions 89*a* of the cam member 8 in the third embodiment are changed to projecting portions 89*d*.

Cam Member

A cam member 8 is a cylindrical body made of synthetic resin and having both ends opened. The cam member 8 includes a tubular portion 89. The cam member 8 has a plurality (e.g., eight) of cam projections 83. The cam projections 83 are formed on a front end face of the cam member 8. The cam projections 83 are formed circumferentially and continuously in a sawtooth shape (a chevron shape). The cam member 8 also has a plurality (e.g., eight) of engagement projections 84. The engagement projections 84 are formed on an outer face of a front end portion of the cam member 8. The engagement projections 84 are also formed discretely along a circumferential direction. The engagement projections 84 are respectively located rearward of the cam projections 83. In a pen point retracting state, the engagement projections 84 are locked at a locking wall portion 63 in a longitudinal direction. The engagement projections 84 are engaged with cam grooves 62 with an amount of play in a rotation direction. The engagement projections 84 are also engaged with cam guide grooves 62*a* with an amount of play in the rotation direction. Specifically, a widthwise size of each cam groove 62 is different from a widthwise size of each engagement projection 84 by 0.19 mm. Likewise, the widthwise size of each engagement projection 84 is different from a widthwise size of each cam guide groove 62*a* by 0.19 mm. Preferably, this amount of play is set within a range from 0.16 to 0.25 mm. More preferably, this amount of play is set within a range from 0.18 to 0.21 mm. However, these values are illustrative, and this amount of play is not limited to thereto.

The cam member 8 also has a plurality (e.g., eight) of projecting portions 89*d* extending in the longitudinal direction. The projecting portions 89*d* are formed on an inner face of a rear-end opening of the tubular portion 89 in the cam member 8. The projecting portions 89*d* are spaced evenly along the circumferential direction. The cam member 8 also has a first inward projection 89*b*. The first inward projection 89*b* is formed on an inner face of the tubular portion 89 and is located frontward of the projecting portions 89*b*. The cam member 8 also has a second inward projection 89*c*. The second inward projection 89*c* is formed on the inner face of the tubular portion 89 and is located frontward of the first inward projection 89*b*. Each of the first inward projection 89*b* and the second inward projection 89*c* is constituted of an annular projection or a plurality of discrete projections. The first inward projection 89*b* is set to be larger in inner diameter than the second inward projection 89*c*. An insertion portion 95 is thus smoothly and easily inserted into the tubular portion 89.

Push Member

The push member 9 includes a clip 91, a clip base portion 92, a shaft portion 94 and the insertion portion 95, and is made of synthetic resin. The clip 91 extends in the longitudinal direction. The clip base portion 92 is formed integrally and continuously with a rear portion of the clip 91. The shaft portion 94 is formed integrally and continuously with the clip base portion 92 and is formed in a cylindrical shape or a columnar shape. The insertion portion 95 is formed integrally and continuously with the shaft portion 94 and is located frontward of the shaft portion 94. The insertion portion 95 is also formed in a cylindrical shape or a columnar shape. A projected bump 91*a* is formed integrally with an inner face of the clip 91 so as to protrude from the inner face of the clip 91. The clip base portion 92 includes a plate-shaped first connection wall portion 92*a* and a plate-shaped second connection wall portion 92*b*. The first connection wall portion 92*a* extends in the longitudinal direction. The second connection wall portion 92*b* is formed integrally and continuously with a rear end of the first connection wall portion 92*a* and extends in a direction perpendicular to an axis. This configuration improves the durability of the clip base portion 92. The projected bump 91*a* of the clip 91 is formed in a plate shape extending in the longitudinal direction, and is engaged with a slide groove 66 in an outer face of a rear barrel 6 so as to be movable in the longitudinal direction. This configuration prevents rotation of the clip 91.

The clip base portion 92 is insertable into a slide hole 64. When the push member 9 is pressed frontward in transition from a pen point retracting state to a pen point protruding state, the first connection wall portion 92*a* is inserted into a narrower front-side hole 64*a* of the slide hole 64, and the second connection wall portion 92*b* is inserted into a wider rear-side hole 64*b* of the slide hole 64. This configuration further prevents rotation of the clip 91 at the time when the push member 9 is pressed frontward.

The insertion portion 95 has a small-diameter front portion, and a large-diameter rear portion that is larger in outer diameter than the small-diameter front portion. The push member 9 has a plurality (e.g., eight) of recessed portions 95*d* extending in the longitudinal direction. The recessed portions 95*d* are formed in an outer face of the large-diameter rear portion, and are spaced evenly along the circumferential direction. The push member 9 also has a first outward projection 95*b*. The first outward projection 95*b* is formed on an outer face of the insertion portion 95 (an outer face of the small-diameter front portion) and is located frontward of the recessed portions 95*d*. The push member 9 also has a second outward projection 95*c*. The second outward projection 95*c* is formed on the outer face of the insertion portion 95 (the outer face of the small-diameter front portion) and is located frontward of the first outward projection 95*b*. Each of the first outward projection 95*b* and the second outward projection 95*c* is constituted of an annular projection or a plurality of discrete projections. The first outward projection 95*b* is set to be larger in outer diameter than the second outward projection 95*c*. The insertion portion 95 is thus smoothly and easily inserted into the tubular portion 89. The clip 91, the clip base portion 92 (the second connection wall portion 92*b*) and the shaft portion 94 respectively have rear end faces that are flush with one another and are defined as a press operation face (push face).

The insertion portion 95 of the push member 9 is inserted into the tubular portion 89 of the cam member 8. The outer face of the insertion portion 95 is connected by fitting to the inner face of the tubular portion 89. In the state in which the outer face of the insertion portion 95 is fitted to the inner face of the tubular portion 89, (a) the recessed portions 95*d* in the outer face of the insertion portion 95 are engaged with the projecting portions 89*d* on the inner face of the tubular portion 89, (b) the first outward projection 95*b* on the outer face of the insertion portion 95 is locked by climbing over the first inward projection 89*b* on the inner face of the tubular portion 89, and (c) the second outward projection 95*c* on the outer face of the insertion portion 95 is locked by climbing over the second inward projection 89*c* on the inner face of the tubular portion 89. The recessed portions 95*d* and the projecting portions 89*d* are brought into detent engagement with each other with play in the rotation direction. An amount of play between the cam grooves 62 and the engagement projections 84 in the rotation direction is set to be larger than an amount of play between the recessed portions 95*d* and the projecting portions 89*d* in the rotation direction. Specifically, a widthwise size of each recessed portion 95*d* is different from a widthwise size of each projecting portion 89*d* by 0.10 mm. Preferably, this amount of play is set within a range from 0.01 to 0.15 mm. More preferably, this amount of play is set within a range from 0.01 to 0.12 mm. However, these values are illustrative, and this amount of play is not limited to thereto. In the present embodiment, in other words, the amount of play between the cam grooves 62 and the engagement projections 84 in the rotation direction is set to be larger than the amount of play between the recessed portions 95*d* and the projecting portions 89*d* in the rotation direction. An abutment step portion 96 is formed between the shaft portion 94 and the insertion portion 95. When the outer face of the insertion portion 95 is connected to the inner face of the tubular portion 89, the rear end of the cam member 8 abuts against the abutment step portion 96.

Other configurations, operations and effects are the same as those in the first and third embodiments; therefore, the description thereof will not be given here.

<Fifth Embodiment>

A retractable writing instrument according to a fifth embodiment of the present invention will be described with reference to the drawings (see FIGS. 28 to 33). Components (i.e., a barrel 2, a writing element 3, a rotary member 7, and a resilient element 10) in the present embodiment are equal to those in the first embodiment except for a cam member 8 and a push member 9.

A retractable writing instrument 1 according to the present embodiment is configured as follows. Thermochromic ink 34 is retained in a writing element 3. A pen point 31 from which the thermochromic ink 34 is dischargeable is disposed on a front end of the writing element 3. The writing element 3 is accommodated in a barrel 2 and is movable in a longitudinal direction. A push member 9 is disposed on a rear end portion of the barrel 2. When the push member 9 is pressed frontward, a protruding and retracting mechanism causes the pen point 31 to protrude from the barrel 2 through a front-end hole 41 in the barrel 2. When the push member 9 is pressed frontward again, the protruding and retracting mechanism cancels the pen point protruding state and causes the pen point 31 to retract into the barrel 2 through the front-end hole 41 in the barrel 2. A rub portion 12 is disposed on an outer face of a rear end portion of the push member 9. A writing with the thermochromic ink 34 is rubbed with the rub portion 12 and is thermally discolored by frictional heat generated at the time of rubbing. The push member 9 includes a main body 93 that is insertable into the rear end portion of the barrel 2, and a prominence 92 that is formed on an outer face of the main body 93 and extends outward in a radial direction. A slide hole 64 extending in the longitudinal direction is formed in a sidewall of the rear end portion of the barrel 2 and is opened rearward at a rear end of the barrel 2. In the pen point protruding state, a front end portion of the prominence 92 is inserted into the slide hole 64. In a pen point retracting state, the front end portion of the prominence 92 is located rearward of the slide hole 64. A guide groove 65 extending in the longitudinal direction is formed in an inner face of the sidewall of the rear end portion of the barrel 2 and is opened rearward at the rear end of the barrel. A guide projection 93*a* is formed on an outer face of the main body 93 of the push member 9 and is engageable with the guide groove 65 in a circumferential direction. In the pen point retracting state, the push member 9 is rotatable with respect to the barrel 2. In a state in which the guide projection 93*a* is engaged with the guide groove 65, the prominence 92 is inserted into the slide hole 64, and the push member 9 is movable in the longitudinal direction. In a state in which the guide projection 93*a* is disengaged from the guide groove 65, the prominence 92 of the push member 9 is restricted at the rear end of the barrel 2. The movement of the push member 9 in the longitudinal direction is thus inhibited.

The retractable writing instrument 1 according to the present embodiment includes the barrel 2, the writing element 3 that is accommodated in the barrel 2, and the protruding and retracting mechanism that causes the pen point 31 of the writing element 3 to protrude from and retract into the barrel 2 through the front-end hole 41 in the barrel 2.

Writing Element

The writing element 3 includes the pen point 31, a reservoir 32, the thermochromic ink 34 and a follower 35. The reservoir 32 has an opening to which the pen point 31 is fixed by press fitting. The thermochromic ink 34 is filled in the reservoir 32. The follower 35 (e.g., a high viscous fluid) is filled subsequent to the thermochromic ink 34 and moves frontward with consumption of the thermochromic ink 34.

For example, the pen point 31 may have either a configuration composed of only a ballpoint pen that is made of metal and enfolds a ball in a rotatable manner at a front end thereof or a configuration composed of a pen point holder that is made of synthetic resin and holds an outer face of a rear portion of a ballpoint pen tip. The writing element 3 also includes a tail plug 33. The tail plug 33 is attached to a rear-end opening of the reservoir 32 and has a vent for ventilation from the reservoir 32 to the outside.

Barrel

The barrel 2 includes a front barrel 4, a middle barrel 5 and a rear barrel 6. The middle barrel 5 is connected to a rear end portion of the front barrel 4. The rear barrel 6 is connected to a rear end portion of the middle barrel 5.

The front barrel 4 is a tapered cylindrical body made of metal or synthetic resin. The front barrel 4 has the front-end hole 41 through which the pen point 31 protrudes and retracts. The front-end hole 41 is formed in a front end of the front barrel 4 and penetrates the front barrel 4 in an axial direction. The front barrel 4 also has a resilient element holding portion 42. The resilient element holding portion 42 is formed integrally with an inner face of the front barrel 4. The resilient element holding portion 42 includes a holding wall portion 42*a* to which an outer peripheral face of a front end portion of a resilient element 10 is fitted, and a locking step portion 42*b* at which the front end of the resilient element 10 is locked. The front barrel 4 also has a female screw portion. The female screw portion is formed on an inner face of a rear-end opening of the front barrel 4.

The middle barrel 5 is a cylindrical body made of synthetic resin and having both ends opened. The middle barrel 5 has a male screw portion. The male screw portion is formed on an outer face of a front end portion of the middle barrel 5. The male screw portion is screwable into the female screw portion of the front barrel 4. The middle barrel 5 also has a male screw portion. The male screw portion is formed on an outer face of a rear end portion of the middle barrel 5. The male screw portion is screwable into a female screw portion of the rear barrel 6. The middle barrel 5 also has a grip portion 51. The grip portion 51 is made of elastic material and is formed on an outer face of a middle portion of the middle barrel 5. The grip portion 51 is provided on an outer face of the middle barrel 5 by double molding or as a separate member attached to the front barrel 4.

The rear barrel 6 is a cylindrical body made of synthetic resin and having both ends opened. The rear barrel 6 has the female screw portion. The female screw portion is formed on an inner face of a front-end opening of the rear barrel 6. The male screw portion on the outer face of the rear end portion of the middle barrel 5 is screwable into the female screw portion. The rear barrel 6 also has a plurality (e.g., four) of cam teeth 61 and a plurality (e.g., four) of cam grooves 62. The cam teeth 61 and the cam grooves 62 are formed integrally with an inner face of a rear portion of the rear barrel 6 and extend in the longitudinal direction. The cam teeth 61 and the cam grooves 62 are arranged alternately along the circumferential direction. The rear barrel 6 also has cam guide grooves 62*a*. The cam guide grooves 62*a* are formed in the respective cam teeth 61 and extend in the longitudinal direction. The cam guide grooves 62*a* and the cam grooves 62 are spaced evenly and arranged alternately along the circumferential direction. The rear barrel 6 also has a locking wall portion 63 that is formed integrally with rear ends of the cam grooves 62. The rear barrel 6 also has the slide hole 64 extending in the longitudinal direction. The slide hole 64 is formed in a sidewall of the rear barrel 6 and is located rearward of the locking wall portion 63. In addition, the slide hole 64 is opened rearward at a rear end of the rear barrel 6. The rear barrel 6 also has one guide groove 65 extending in the longitudinal direction. The guide groove 65 is formed in an inner face of a rear-end opening of the rear barrel 6 and is located opposite the slide hole 64. The guide groove 65 penetrates the locking wall portion 63 and communicates with one of the cam grooves 62. The slide hole 64 includes a narrower front-side hole 64*a* and a wider rear-side hole 64*b* that communicates with the front-side hole 64*a* and is opened rearward. The rear barrel 6 also has a slide groove 66 that is formed in the outer face of the barrel 2. The slide groove 66 is located frontward of the slide hole 64 and is engageable with a projected bump 91*a* of a clip 91 (see FIG. 10).

Protruding and Retracting Mechanism

The protruding and retracting mechanism is a push-type protruding and retracting mechanism employing a rotary cam mechanism. The protruding and retracting mechanism includes the cam teeth 61 and cam grooves 62, a rotary member 7, a cam member 8, the push member 9 and the resilient element 10. The cam teeth 61 and the cam grooves 62 are formed on and in the inner face of the barrel 2 (the inner face of the rear barrel 6). The rotary member 7 engages with the cam teeth 61 or the cam grooves 62 and abuts against a rear end of the writing element 3. The cam member 8 engages with the rotary member 7 and the cam grooves 62. The push member 9 is connected to the cam member 8. The resilient element 10 (e.g., a compression coil spring) is accommodated in the barrel 2 and biases the writing element 3 rearward. The protruding and retracting mechanism in the present embodiment is of a double push type that the push member 9 is pressed frontward by both a pen point protruding operation and a pen point retracting operation.

Rotary Member

The rotary member 7 is a cylindrical body made of synthetic resin and having both ends opened. The rotary member 7 has an annular flange portion 71. The annular flange portion 71 is formed on a front end portion of the rotary member 7. The rotary member 7 also has a large-diameter tube portion 72. The large-diameter tube portion 72 is formed rearward of the annular flange portion 71 of the rotary member 7. The rotary member 7 also has a small-diameter tube portion 73 smaller in outer diameter than the large-diameter tube portion 72. The small-diameter tube portion 73 is formed rearward of the large-diameter tube portion 72 of the rotary member 7. The rotary member 7 also has a step portion 74. The step portion 74 is formed on an inner face of the front end portion of the rotary member 7. The rear end of the writing element 3 (the tail plug 33 attached to the rear end of the writing element 3) abuts against the step portion 74. The rotary member 7 also has a plurality (e.g., four) of protuberances 75. The protuberances 75 are formed on an outer face of the large-diameter tube portion 72 (at a position rearward of the annular flange portion 71 and frontward of the small-diameter tube portion 73). The protuberances 75 are engageable with the cam grooves 62 and extend in the longitudinal direction. The rotary member 7 also has cam slopes 76. The cam slopes 76 are formed on rear ends of the protuberances 75 and are abuttable against the cam teeth 61 and cam projections 83 of the cam member 8. The small-diameter tube portion 73 is inserted with play into an inner face of a front end portion of the cam member 8 (an inner face of a large-diameter front portion 81) (see FIG. 11).

Cam Member

The cam member 8 is a one-end closed cylindrical body made of synthetic resin. In other words, the cam member 8 has a front end that is opened and a rear end that is closed. The cam member 8 has a large-diameter front portion 81 and a small-diameter rear portion 82 (insertion portion) smaller in outer diameter than the front portion 81. The rear portion 82 is formed integrally and continuously with the front portion 81 and is located rearward of the front portion 81. The cam member 8 also has a plurality (e.g., eight) of cam projections 83. The cam projections 83 are formed on a front end face of the cam member 8 (a front end face of the large-diameter front portion 81). The cam projections 83 are also formed circumferentially and continuously in a saw-tooth shape (a chevron shape). The cam member 8 also has a plurality (e.g., eight) of engagement projections 84. The engagement projections 84 are formed on an outer face of a front end portion of the cam member 8 (an outer face of a front end portion of the large-diameter front portion 81). The engagement projections 84 are also formed discretely along the circumferential direction. The engagement projections 84 are respectively located rearward of the cam projections 83. In the pen point retracting state, the engagement projections 84 are locked at the locking wall portion 63 in the longitudinal direction. The engagement projections 84 are engaged with the cam grooves 62 with an amount of play in a rotation direction. The engagement projections 84 are also engaged with the cam guide grooves 62*a* with an amount of play in the rotation direction (see FIG. 32).

The cam member 8 also has a first outward projection 86. The first outward projection 86 is formed on the outer face of the small-diameter rear portion 82 (insertion portion) of the cam member 8. The cam member 8 also has a second outward projection 87. The second outward projection 87 is formed on the outer face of the small-diameter rear portion 82 (insertion portion) and is located rearward of the first outward projection 86. Each of the first outward projection 86 and the second outward projection 87 is constituted of an annular projection or a plurality of discrete projections. The first outward projection 86 is set to be larger in outer diameter than the second outward projection 87. The small-diameter rear portion 82 (insertion portion) is thus smoothly and easily inserted into a tubular portion 93 (see FIG. 29).

Push Member

The push member 9 includes the clip 91, a clip base portion 92 and a one-end closed tubular main body 93, and is made of synthetic resin. The clip 91 extends in the longitudinal direction. The clip base portion 92 (prominence) is formed integrally and continuously with a rear portion of the clip 91. The main body 93 is formed integrally and continuously with the clip base portion 92. The projected bump 91*a* is formed integrally with an inner face of the clip 91 so as to protrude from the inner face of the clip 91. The clip base portion 92 includes a plate-shaped first connection wall portion 92*a* and a plate-shaped second connection wall portion 92*b*. The first connection wall portion 92*a* extends in the longitudinal direction. The second connection wall portion 92*b* is formed integrally and continuously with a rear end of the first connection wall portion 92*a* and extends in a direction perpendicular to an axis. This configuration improves the durability of the clip base portion 92. The projected bump 91*a* of the clip 91 is formed on a plate shape extending in the longitudinal direction, and is engaged with the slide groove 66 in the outer face of the rear barrel 6 so as to be movable in the longitudinal direction (see FIGS. 31 and 33).

The clip base portion 92 is insertable into the slide hole 64. When the push member 9 is pressed frontward in transition from the pen point retracting state to the pen point protruding state, the first connection wall portion 92*a* is inserted into the narrower front-side hole 64*a* of the slide hole 64, and the second connection wall portion 92*b* is inserted into the wider rear-side hole 64*b* of the slide hole 64.

The push member 9 has one guide projection 93*a*. The guide projection 93*a* is formed integrally with an outer face of the main body 93 and is located opposite the clip base portion 92 in a radial direction. The push member 9 also has a first inward projection 93*c*. The first inward projection 93*c* is formed on an inner face of the main body 93. The push member 9 also has a second inward projection 93*d*. The second inward projection 93*d* is formed on the inner face of the tubular portion 93 and is located rearward of the first inward projection 93*c*. Each of the first inward projection 93*c* and the second inward projection 93*d* is constituted of an annular projection or a plurality of discrete projections. The first inward projection 93*c* is set to be larger in inner diameter than the second inward projection 93*d*. The small-diameter rear portion 82 (insertion portion) is thus smoothly and easily inserted into the tubular portion 93 (see FIG. 29).

The push member 9 also has the rub portion 12. The rub portion 12 is made of elastic material and is attached to a rear end face of the main body 93. The push member 9 also has a rod-shaped protrusion 97. The rod-shaped protrusion 97 is formed on the rear end face of the main body 93 of the push member 9 so as to extend rearward. The rod-shaped protrusion 97 has an annular outward projection formed on an outer face thereof. The rub portion 12 made of tubular elastic material is attached by press fitting to the outer face of the rod-shaped protrusion 97. In the state in which the rub portion 12 is attached to the rod-shaped protrusion 97, the annular outward projection on an outer face of the rod-shaped protrusion 97 is locked by climbing over an annular inward projection on an inner face of the rub portion 12. The rub portion 12 is thus prevented from coming off the rod-shaped protrusion 97 in the rubbing operation. The rear end of the rod-shaped protrusion 97 is located frontward of a rear end face of the rub portion 12. In other words, the rear end of the rod-shaped protrusion 97 does not protrude rearward from the rear end face of the rub portion 12. According to this structure, in protruding or retracting the push member 9, a finger does not come into contact with the rod-shaped protrusion 97. This structure thus enables stable and slipless contact of the rear end face of the rub portion 12 with the finger. It should be noted that the rub portion attachment structure is not limited thereto.

The small-diameter rear portion 82 (insertion portion) of the cam member 8 is inserted into the main body 93 of the push member 9. The outer face of the small-diameter rear portion 82 is connected by fitting to the inner face of the main body 93. In the state in which the outer face of the small-diameter rear portion 82 is fitted to the inner face of the main body 93, the first outward projection 86 on the outer face of the small-diameter rear portion 82 is locked by climbing over the first inward projection 93*c* on the inner face of the main body 93, and the second outward projection 87 on the outer face of the small-diameter rear portion 82 is locked by climbing over the second inward projection 93*d* on the inner face of the main body 93. In addition, an abutment step portion 81*a* is formed on a rear end of the large-diameter front portion 81, and the front end of the main body 93 abuts against the abutment step portion 81*a* (see FIG. 29).

The guide projection 93*a* of the push member 9 is engaged with the guide groove 65 in the inner face of the rear-end opening of the rear barrel 6 and one of the cam grooves 62 communicating with the guide groove 65 in the longitudinal direction, so as to be movable in the longitudinal direction. In the pen point retracting state, the guide projection 93*a* is engaged with the guide groove 65. In the pen point protruding state, when the pen point is directed downward, the gravity moves the push member 9 downward, so that the guide projection 93*a* is engaged with one of the cam grooves 62.

Pen Point Protruding and Retracting Action

In the pen point retracting state, the engagement projections 84 of the cam member 8 are locked at the locking wall portion 63 on the rear ends of the cam grooves 62, the protuberances 75 of the rotary member 7 are engaged with the cam grooves 62, and the cam slopes 76 on the rear ends of the protuberances 75 in the rotary member 7 are in abutment with the cam projections 83. The resilient element 10 always biases the writing element 3 rearward.

In the pen point retracting state, when the push member 9 is pressed frontward against the rearward biasing force of the resilient element 10, the protuberances 75 and the engagement projections 84 move frontward along the cam grooves 62, so that the protuberances 75 are disengaged from the cam grooves 62 in the frontward direction. At the same time, the rotary member 7 is rotated by the contact of the cam slopes 76 with the cam projections 83, and the cam slopes 76 on the rear ends of the protuberances 75 are engaged with the cam teeth 61, so that the pen point protruding state is maintained.

In the pen point protruding state, when the push member 9 is pressed frontward against the rearward biasing force of the resilient element 10, the protuberances 75 and the engagement projections 84 move frontward, and the rotary member 7 is rotated by the contact of the cam slopes 76 with the cam projections 83, so that the cam slopes 76 on the rear ends of the protuberances 75 are disengaged from the cam teeth 61. Thereafter, when the frontward press on the push member 9 is canceled, the rearward biasing force of the resilient element 10 causes the rotary member 7 and the cam member 8 to move rearward. The protuberances 75 are thus engaged with the cam grooves 62 and moved rearward along the cam grooves 62. Thereafter, the engagement projections 84 of the cam member 8 are locked at the locking wall portion 63 on the rear ends of the cam grooves 62. The pen point retracting state is thus established.

In the present embodiment, the writing element 3 is exchangeable since the middle barrel 5 is screwed into the front barrel 4 in the detachable manner. The writing element 3 is also exchangeable since the middle barrel 5 is screwed into the rear barrel 6 in the detachable manner.

With regard to the retractable writing instrument 1 according to the present embodiment, in the rubbing operation using the rub portion 12, the push member 9 is rotated with respect to the barrel 2, so that the guide projection 93*a* is disengaged from the guide groove 65. With this structure, even when the push member 9 is pressed frontward, the clip base portion (prominence) 92 of the push member 9 is restricted at a position away from the slide hole 64 in the rear end of the barrel 2 in the circumferential direction. The push member 9 is thus prevented from moving with respect to the barrel 2 in the longitudinal direction. As a result, the stable rubbing operation is achieved using the rub portion 12 on the rear end of the push member 9 (see FIGS. 29, 30 and 31).

With regard to the retractable writing instrument 1 according to the present embodiment, in protruding or retracting the pen point, the push member 9 is rotated with respect to the barrel 2, so that the guide projection 93*a* is engaged with the guide groove 65. When the push member 9 is moved in the longitudinal direction in this state, the clip base portion 92 moves inside the slide hole 64 in the longitudinal direction while the guide projection 93*a* moves inside the guide groove 65 in the longitudinal direction. The pen point thus protrudes from or retracts into the barrel 2. With regard to the retractable writing instrument 1 according to the present embodiment, in the state in which the guide projection 93*a* is disengaged from the guide groove 65, the guide projection 93*a* is brought into press contact with the circumferential inner face of the barrel or is engaged with a dent portion 67 formed in the inner face of the barrel 2. In the case where the guide projection 93*a* is engaged with the dent portion 67, the clip base portion (prominence) 92 is reliably separated from the slide hole 64 in the circumferential direction. When a widthwise size of the dent portion 67 is made larger than a widthwise size of the guide groove 65, the guide projection 93*a* is more easily engaged with the dent portion 67. In addition, an injection molding gate portion may be located at an inner face of the dent portion 67. In addition, an edge portion of the guide groove 65 in the circumferential direction, an edge portion of the dent portion 67 in the circumferential direction and a corner portion of the guide projection 93*a* in the circumferential direction are each formed in a convex curve shape. Each of the guide groove 65 and the dent portion 67 is thus smoothly engaged with and disengaged from the guide projection 93*a*. In the case where the guide projection 93*a* is brought into press contact with the circumferential inner face of the barrel, the frictional force keeps this state. The frictional force produces an effect of suppressing the movement of the push member 9 relative to the barrel 2 in the longitudinal direction.

Push Member-specific Resilient Element

Figure 33:
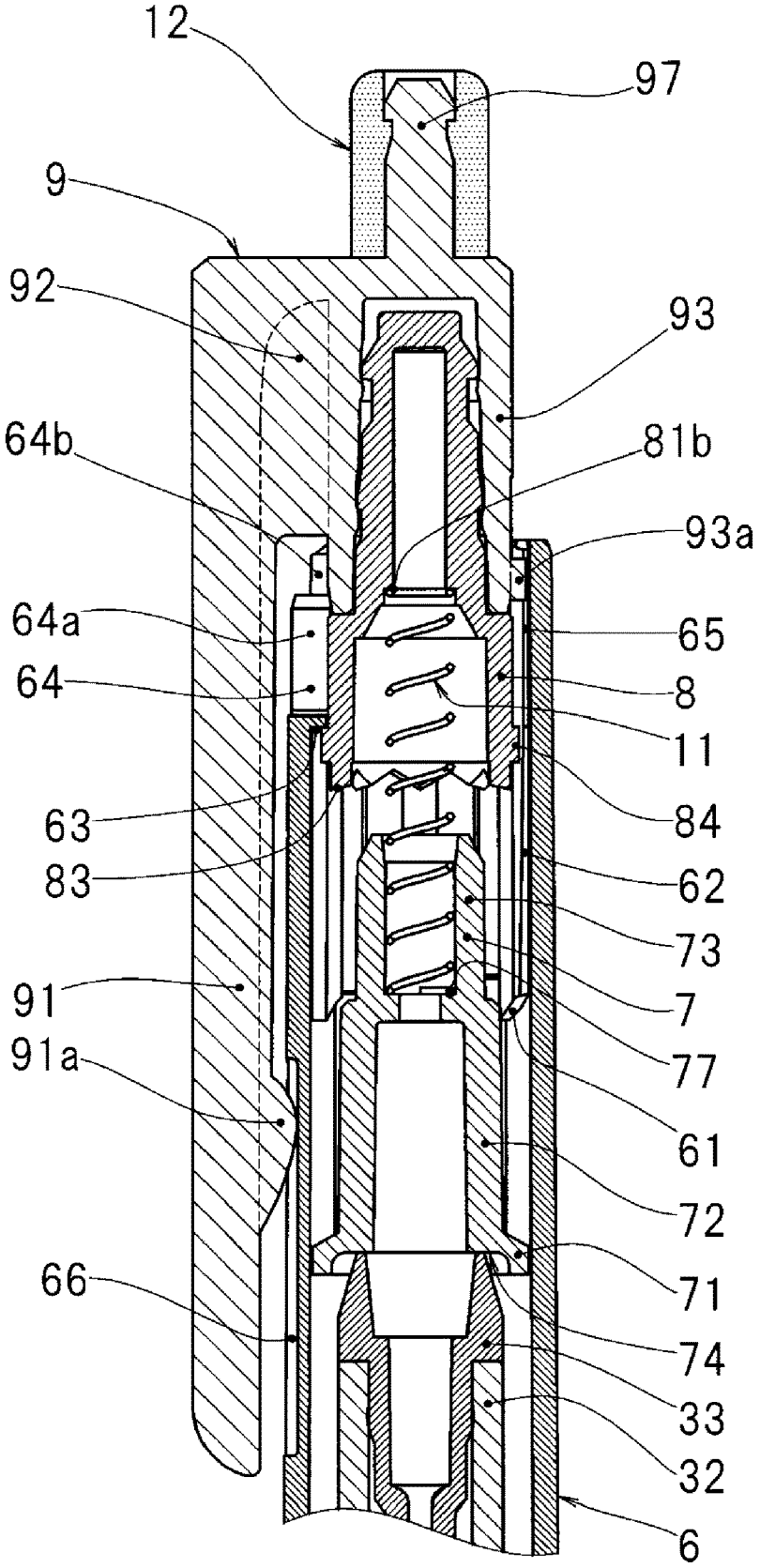
FIG. 33 is an enlarged longitudinal sectional view of a main part in the fifth embodiment of the present invention and illustrates a configuration in which a push member-specific resilient element is additionally provided.

In the foregoing embodiments, a push member-specific resilient element 11 may be disposed between the rotary member 7 and the cam member 8 (see FIG. 33). A resilient force of the push member-specific resilient element 11 is set to be smaller than a resilient force of the resilient element 10. The push member-specific resilient element 11 has a front end portion that is locked at a locking portion 77 on the inner face of the rotary member 7, and a rear end portion that is locked at a locking portion 81*b* on the inner face of the cam member 8. With this configuration, the push member 9 is always biased rearward. Even in the pen point protruding state, the clip base portion 92 (prominence) of the push member 9 is separated from the slide hole in the rearward direction, so that the clip base portion 92 (prominence) is located rearward of the rear end of the barrel 2. The push member 9 is thus rotated in both the pen point protruding state and the pen point retracting state. The rubbing operation is therefore started quickly.

With regard to conventional thermochromic retractable writing instruments each configured to press a push member on a rear end of a barrel frontward, when a rub portion is provided on a rear end of the push member, the push member moves toward a pen point in rubbing operation using the rub portion, which may cause the unstable rubbing operation (refer to, for example, WO 2008/105227 A1). In contrast to this, the present embodiment provides a thermochromic retractable writing instrument that enables stable rubbing operation using a rub portion on a rear end of a push member.

The embodiments and aspects of the present invention have been described above. However, the contents of the disclosure may change depending on the details of the configuration. The combinations of the elements and the changes of the sequence in the embodiments and aspects are achieved without departing from the scope and idea of the present invention.

REFERENCE SIGNS LIST

1 retractable writing instrument
2 barrel
3 writing element
31 pen point

32 reservoir
33 tail plug
34 ink
35 follower
4 front barrel
41 front-end hole
42 resilient element holding portion
42*a* holding wall portion
42*b* locking step portion
5 middle barrel
51 grip portion
6 rear barrel
61 cam teeth
62 cam groove
62*a* cam guide groove
63 locking wall portion
64 slide hole
64*a* front-side hole
64*b* rear-side hole
65 guide groove
66 slide groove
67 dent portion
7 rotary member
71 annular flange portion
72 large-diameter tube portion
73 small-diameter tube portion
74 step portion
75 protuberance
76 cam slope
77 locking portion
8 cam member
81 front portion
81*a* abutment step portion
81*b* locking portion
82 rear portion (insertion portion)
83 cam projection
84 engagement projection
85 projecting portion
86 first outward projection
87 second outward projection
88 recessed portion
89 tubular portion
89*a* recessed portion
89*b* first inward projection
89*c* second inward projection
89*d* projecting portion
9 push member
91 clip
91*a* projected bump
92 clip base portion
92*a* first connection wall portion
92*b* second connection wall portion
93 tubular portion (main body)
93*a* guide projection
93*b* recessed portion
93*c* first inward projection
93*d* second inward projection
93*e* projecting portion
94 shaft portion
95 insertion portion
95*a* projecting portion
95*b* first outward projection
95*c* second outward projection
95*d* recessed portion
96 abutment step portion
97 rod-shaped protrusion
10 resilient element
11 push member-specific resilient element
12 rub portion

The invention claimed is:

1. A retractable writing instrument comprising:
a barrel;
a writing element that is accommodated in the barrel and is movable in a longitudinal direction;
a push member that includes a clip and is disposed on a rear end portion of the barrel; and
a protruding and retracting mechanism that causes a pen point of the writing element to protrude from and retract into a front end of the barrel at a frontward press on the push member,
the protruding and retracting mechanism including:
a plurality of cam teeth and a plurality of cam grooves that are formed on and in an inner face of the barrel, are arranged alternately along a circumferential direction, and extend in the longitudinal direction;
a rotary member that is rotatably disposed rearward of the writing element and includes a plurality of protuberances engageable alternately with the cam teeth or the cam grooves;
a cam member that is connected to the push member and includes a plurality of cam projections rotating the rotary member, and a plurality of engagement projections engaged with the cam grooves in the inner face of the barrel so as to be movable in the longitudinal direction; and
a resilient element that biases the writing element rearward,
wherein
the push member and the cam member are in detent engagement with each other.

2. The retractable writing instrument according to claim 1, wherein
the push member includes a tubular portion inserted into a rear-end opening of the barrel,
the cam member includes an insertion portion inserted into the tubular portion, and
an inner wall of the tubular portion and an outer wall of the insertion portion are in detent engagement with each other.

3. The retractable writing instrument according to claim 2, wherein
a plurality of recessed portions extending in the longitudinal direction are formed in an inner face of the tubular portion,
a plurality of projecting portions engageable with the recessed portions are formed on an outer face of the insertion portion, and
the push member and the cam member are in detent engagement with each other by engagement of the recessed portions with the projecting portions.

4. The retractable writing instrument according to claim 3, wherein
an amount of play between the cam grooves and the engagement projections in a rotation direction is set to be larger than an amount of play between the recessed portions and the projecting portions in the rotation direction.

5. The retractable writing instrument according to claim 1, wherein
a locking wall portion at which the engagement projections are locked in the longitudinal direction in a pen point retracting state is formed on rear ends of the cam grooves, a guide groove communicating with one of the cam grooves and extending in the longitudinal direction is formed in the inner face of the barrel and is located rearward of the cam grooves, a guide projection is formed on an outer face of a tubular portion in the push member, the guide projection is engaged with the guide groove in the pen point retracting state, and the guide projection is engaged with one of the cam grooves in a pen point protruding state.

6. The retractable writing instrument according to claim 1, wherein the push member includes:

the clip;

a clip base portion that is formed integrally and continuously with a rear portion of the clip; and a tubular portion that is formed integrally and continuously with the clip base portion, a slide hole extending in the longitudinal direction is formed in a sidewall of the rear end portion of the barrel and is opened rearward at a rear end of the barrel, a front end portion of the clip base portion is inserted into the slide hole in a pen point protruding state, and the front end portion of the clip base portion is located rearward of the slide hole in a pen point retracting state.

7. The retractable writing instrument according to claim 2, wherein a plurality of projecting portions extending in the longitudinal direction are formed on an inner face of the tubular portion, a plurality of recessed portions engageable with the projecting portions are formed in an outer face of the insertion portion, and the push member and the cam member are in detent engagement with each other by engagement of the projecting portions with the recessed portions.

8. The retractable writing instrument according to claim 7, wherein an amount of play between the cam grooves and the engagement projections in a rotation direction is set to be larger than an amount of play between the projecting portions and the recessed portions in the rotation direction.

9. The retractable writing instrument according to claim 7, wherein a locking wall portion at which the engagement projections are locked in the longitudinal direction in a pen point retracting state is formed on rear ends of the cam grooves, a guide groove communicating with one of the cam grooves and extending in the longitudinal direction is formed in the inner face of the barrel and is located rearward of the cam grooves, a guide projection is formed on an outer face of the tubular portion in the push member, the guide projection is engaged with the guide groove in the pen point retracting state, and the guide projection is engaged with one of the cam grooves in a pen point protruding state.

10. The retractable writing instrument according to claim 7, wherein the push member includes:

the clip;

a clip base portion that is formed integrally and continuously with a rear portion of the clip; and the tubular portion that is formed integrally and continuously with the clip base portion, a slide hole extending in the longitudinal direction is formed in a sidewall of the rear end portion of the barrel and is opened rearward at a rear end of the barrel, a front end portion of the clip base portion is inserted into the slide hole in a pen point protruding state, and the front end portion of the clip base portion is located rearward of the slide hole in a pen point retracting state.

11. The retractable writing instrument according to claim 1, wherein the cam member includes a tubular portion, the push member includes an insertion portion inserted into the tubular portion of the cam member, and an inner wall of the tubular portion and an outer wall of the insertion portion are in detent engagement with each other.

12. The retractable writing instrument according to claim 11, wherein a plurality of recessed portions extending in the longitudinal direction are formed in an inner face of the tubular portion, a plurality of projecting portions engageable with the recessed portions are formed on an outer face of the insertion portion, and the push member and the cam member are in detent engagement with each other by engagement of the recessed portions with the projecting portions.

13. The retractable writing instrument according to claim 12, wherein an amount of play between the cam grooves and the engagement projections in a rotation direction is set to be larger than an amount of play between the recessed portions and the projecting portions in the rotation direction.

14. The retractable writing instrument according to claim 11, wherein the push member includes:

the clip;

a clip base portion that is formed integrally and continuously with a rear portion of the clip; and the insertion portion that is formed integrally and continuously with the clip base portion, a slide hole extending in the longitudinal direction is formed in a sidewall of the rear end portion of the barrel and is opened rearward at a rear end of the barrel, a front end portion of the clip base portion is inserted into the slide hole in a pen point protruding state, and the front end portion of the clip base portion is located rearward of the slide hole in a pen point retracting state.

15. The retractable writing instrument according to claim 11, wherein a plurality of projecting portions extending in the longitudinal direction are formed on an inner face of the tubular portion, a plurality of recessed portions engageable with the projecting portions are formed in an outer face of the insertion portion, and the push member and the cam member are in detent engagement with each other by engagement of the projecting portions with the recessed portions.

16. The retractable writing instrument according to claim 15, wherein an amount of play between the cam grooves and the engagement projections in a rotation direction is set to be larger than an amount of play between the projecting portions and the recessed portions in the rotation direction.

17. The retractable writing instrument according to claim 15, wherein the push member includes:

the clip;

a clip base portion that is formed integrally and continuously with a rear portion of the clip; and the insertion portion that is formed integrally and continuously with the clip base portion, a slide hole extending in the longitudinal direction is formed in a sidewall of the rear end portion of the barrel and is opened rearward at a rear end of the barrel, a front end portion of the clip base portion is inserted into the slide hole in a pen point protruding state, and the front end portion of the clip base portion is located rearward of the slide hole in a pen point retracting state.

18. A retractable writing instrument comprising:

a barrel;

a writing element that is accommodated in the barrel and is movable in a longitudinal direction;

a push member that is disposed on a rear end portion of the barrel; and a protruding and retracting mechanism that causes a pen point of the writing element to protrude from and retract into a front end of the barrel at a frontward press on the push member, the protruding and retracting mechanism including:

a plurality of cam teeth and a plurality of cam grooves that are formed on and in an inner face of the barrel, are arranged alternately along a circumferential direction, and extend in the longitudinal direction;

a rotary member that is rotatably disposed rearward of the writing element and includes a plurality of protuberances engageable alternately with the cam teeth or the cam grooves;

a cam member that is connected to the push member and includes a plurality of cam projections rotating the rotary member, and a plurality of engagement projections engaged with the cam grooves in the inner face of the barrel so as to be movable in the longitudinal direction; and a resilient element that biases the writing element rearward, wherein the push member and the cam member are in detent engagement with each other.

19. A retractable writing instrument comprising:

a barrel;

a writing element that is accommodated in the barrel and is movable in a longitudinal direction;

a push member that is disposed on a rear end portion of the barrel and includes a prominence formed on an outer face of the push member and extending outward in a radial direction; and a protruding and retracting mechanism that causes a pen point of the writing element to protrude from and retract into a front end of the barrel at a frontward press on the push member, the protruding and retracting mechanism including:

a plurality of cam teeth and a plurality of cam grooves that are formed on and in an inner face of the barrel, are arranged alternately along a circumferential direction, and extend in the longitudinal direction;

a rotary member that is rotatably disposed rearward of the writing element and includes a plurality of protuberances engageable alternately with the cam teeth or the cam grooves;

a cam member that is connected to the push member and includes a plurality of cam projections rotating the rotary member, and a plurality of engagement projections engaged with the cam grooves in the inner face of the barrel so as to be movable in the longitudinal direction; and a resilient element that biases the writing element rearward, wherein the push member and the cam member are in detent engagement with each other.

* * * * *